US011510460B2

(12) United States Patent
Hipp

(10) Patent No.: US 11,510,460 B2
(45) Date of Patent: Nov. 29, 2022

(54) DYNAMIC LACING SYSTEM

(71) Applicant: NIKE, Inc., Beaverton, OR (US)

(72) Inventor: Stephen J. Hipp, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 123 days.

(21) Appl. No.: 17/061,623

(22) Filed: Oct. 2, 2020

(65) Prior Publication Data

US 2021/0100318 A1 Apr. 8, 2021

Related U.S. Application Data

(60) Provisional application No. 62/910,086, filed on Oct. 3, 2019.

(51) Int. Cl.
*A43C 11/14* (2006.01)

(52) U.S. Cl.
CPC ..... *A43C 11/14* (2013.01)

(58) Field of Classification Search
CPC ..... A43C 11/14; A43C 11/004; A43C 11/16; A43C 7/08
See application file for complete search history.

(56) References Cited

U.S. PATENT DOCUMENTS 1,910,891 A * 5/1933 Freysinger ..... A41F 1/008 24/593.11
3,385,299 A * 5/1968 Le Roy ..... A61B 17/08 24/593.11
3,953,144 A * 4/1976 Boden ..... F16G 11/106 403/374.2
4,665,590 A * 5/1987 Udelhofen ..... F16G 11/106 24/30.5 R
4,788,755 A * 12/1988 Kasai ..... A45C 13/30 24/136 R
4,878,269 A * 11/1989 Anscher ..... F16G 11/101 24/136 R
5,435,044 A * 7/1995 Ida ..... F16G 11/14 24/136 L (Continued)

FOREIGN PATENT DOCUMENTS

WO WO-2020051278 A1 3/2020

OTHER PUBLICATIONS

European Patent Office (ISA), International Search Report and Written Opinion for PCT Application No. PCT/US2020/053973 dated Dec. 23, 2020.

*Primary Examiner* — David M Upchurch
(74) *Attorney, Agent, or Firm* — Honigman LLP; Matthew H. Szalach; Jonathan P. O'Brien

(57) ABSTRACT

A cable lock includes a housing having a first engagement surface and a second engagement surface. The cable lock also includes a locking member slideably disposed between the first engagement surface and the second engagement surface and including a first lock element opposing the first engagement surface and a second lock element opposing the second engagement surface. The first lock element includes a first series of teeth and a second series of teeth arranged in parallel with the first series of teeth. The first lock element is operable to engage a first portion of a cable. The second lock element includes a first series of teeth and a second series of teeth arranged in parallel with the first series of teeth of the second lock element. The second lock element is operable to engage a second portion of the cable.

18 Claims, 16 Drawing Sheets

(56) References Cited

U.S. PATENT DOCUMENTS

| | | | | | |
|---|---|---|---|---|---|
| 5,454,140 | A * | 10/1995 | Murai | F16G 11/101 | 24/136 R |
| 5,572,770 | A * | 11/1996 | Boden | F16G 11/101 | 24/136 R |
| 5,894,639 | A * | 4/1999 | Boden | F16G 11/106 | 24/115 M |
| 5,987,712 | A * | 11/1999 | Tucker | F16G 11/101 | 24/115 M |
| 6,185,798 | B1 * | 2/2001 | Ton | F16G 11/101 | 24/712.1 |
| 6,457,214 | B1 * | 10/2002 | Boden | F16G 11/101 | 24/136 L |
| 6,889,407 | B2 * | 5/2005 | Martin | A43C 7/00 | 24/136 R |
| 8,321,999 | B2 * | 12/2012 | Boden | F16G 11/101 | 24/136 R |
| 8,371,004 | B2 * | 2/2013 | Huber | A43B 5/0401 | 24/712.1 |
| 9,131,750 | B2 * | 9/2015 | Takahashi | A43C 7/08 | |
| 10,159,291 | B1 * | 12/2018 | Ortega | A43C 11/12 | |
| 10,398,197 | B2 * | 9/2019 | Shimizu | F16G 11/101 | |
| 10,508,713 | B2 * | 12/2019 | Shimizu | F16G 11/106 | |
| 10,767,730 | B2 * | 9/2020 | Romero | A44B 11/10 | |
| 2005/0005477 | A1 * | 1/2005 | Borsoi | F16G 11/106 | 24/712 |
| 2006/0168784 | A1 | 8/2006 | Ahn | | |
| 2011/0067211 | A1 | 3/2011 | Huber et al. | | |
| 2018/0020767 | A1 | 1/2018 | Dyer et al. | | |

* cited by examiner

DYNAMIC LACING SYSTEM

CROSS REFERENCE TO RELATED APPLICATION

This application claims priority under 35 U.S.C. § 119(e) to Provisional U.S. Patent Application No. 62/910,086, filed Oct. 3, 2019, the disclosure of which is hereby incorporated by reference in its entirety.

FIELD

The present disclosure relates generally to articles of footwear having a dynamic lacing system for moving footwear between a tightened state and a loosened state.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear. While fasteners such as hook and loop fasteners are easier and quicker to operate than traditional laces, these fasteners have a propensity to wear out over time and require more attention to attain a desired tension when securing the upper to the foot.

Known automated tightening systems typically include a tightening mechanism, such as rotatable knob, that can be manipulated to apply tension to one or more cables that interact with the upper for closing the upper around that foot. While these automated tightening systems can incrementally increase the magnitude of tension of the one or more cables to achieve the desired fit of the upper around the foot, they require a time-consuming task of manipulating the tightening mechanism to properly tension the cables for securing the upper around the foot. Further, when it is desired to remove the footwear from the foot, the wearer is often required to simultaneously depress a release mechanism and pull the upper away from the foot to release the tension of the cables. Thus, known automated tightening systems lack suitable provisions for both quickly adjusting the tension of the cables to close the upper around the foot and quickly releasing the tension applied to the cables so that the upper can be quickly loosened for removing the footwear from the foot. Moreover, the tightening mechanism employed by these known automated tightening systems is required to be incorporated onto an exterior of the upper so that the tightening mechanism is accessible to the wearer for adjusting the fit of the upper around the foot, thereby detracting from the general appearance and aesthetics of the footwear.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
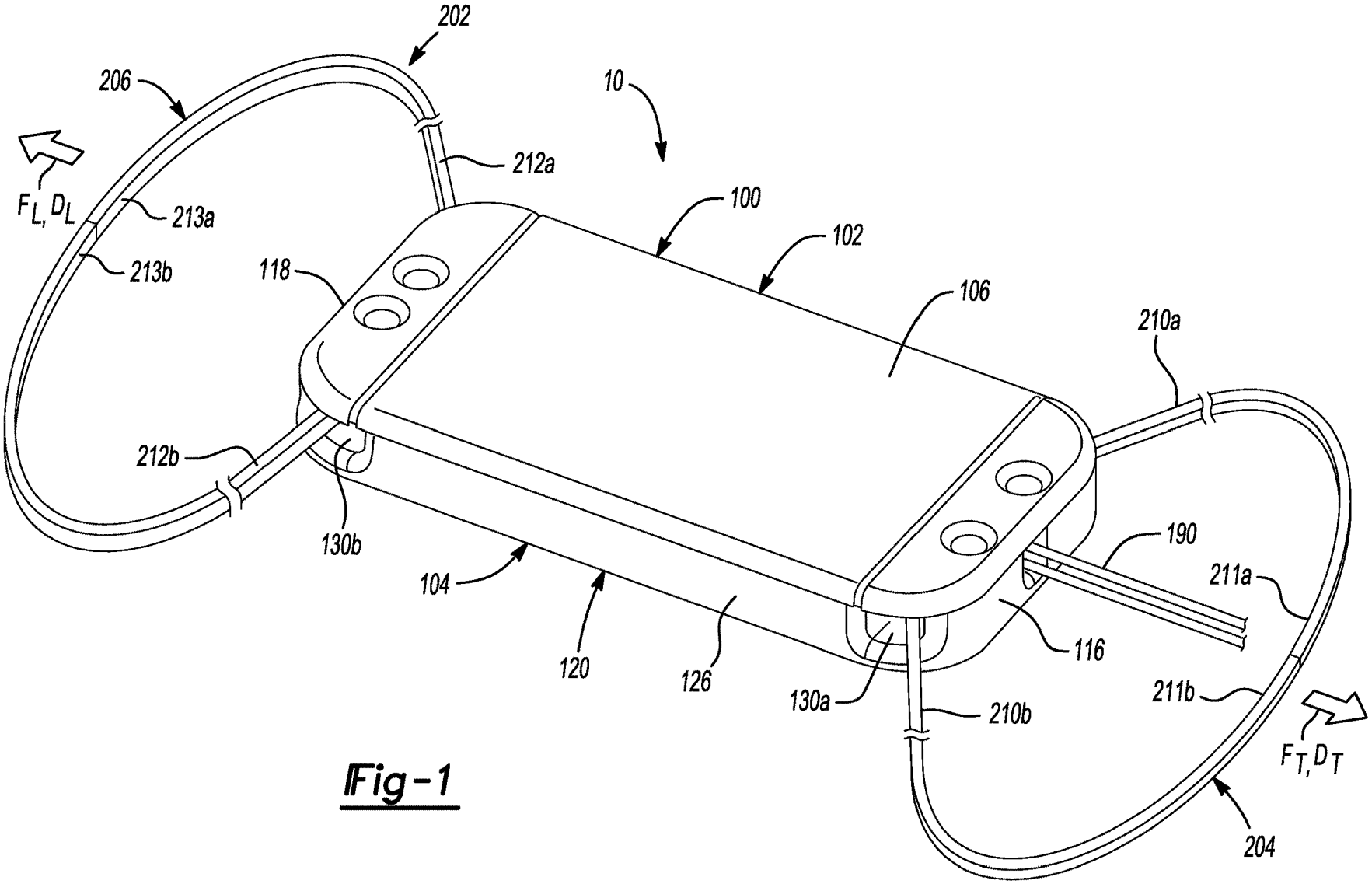
FIG. 1 is a perspective view of a cable lock and cable according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a cable lock. The cable lock includes a housing having a first engagement surface and a second engagement surface spaced apart from the first engagement surface. The cable lock also includes a locking member slideably disposed between the first engagement surface and the second engagement surface and having a first lock element opposing the first engagement surface to define a first locking channel and a second lock element opposing the second engagement surface to define a second locking channel. The first lock element (i) includes a first series of teeth and a second series of teeth arranged in parallel with the first series of teeth and (ii) is operable to engage a first portion of a cable disposed within the first locking channel. The second lock element (i) includes a first series of teeth and a second series of teeth arranged in parallel with the first series of teeth of the second lock element and (ii) is operable to engage a second portion of the cable disposed within the second locking channel.

Implementations of the disclosure may include one or more of the following optional features. In some implementations, the locking member includes a bottom surface and a top surface formed on an opposite side of the locking member from the bottom surface, the first series of teeth of the first lock element and the second lock element extending adjacent to the bottom surface and the second series of teeth of the first lock element and the second lock element extending adjacent to the top surface. The first series of teeth of the first lock element and the second lock element may be staggered from the second series of teeth of the first lock element and the second lock element, respectively. The first series of teeth of the first lock element and the second lock element may include a first series of recesses formed between adjacent ones of the teeth of the first series of teeth, each of the teeth of the second series of teeth of the first lock element and the second lock element being aligned with one of the recesses of the first series of recesses. The second series of teeth of the first lock element and the second lock element may include a second series of recesses formed between adjacent ones of the teeth of the second series of teeth, each of the teeth of the first series of teeth of the first lock element and the second lock element being aligned with one of the recesses of the second series of recesses.

In some examples, each of the first lock element and the second lock element is formed at an oblique angle relative to a longitudinal axis of the locking member. The oblique angle may range from 2 degrees to 12 degrees. Additionally or alternatively, the oblique angle may range from 4 degrees to 8 degrees or the oblique angle may be 6 degrees. The first lock element may be parallel to the first engagement surface and the second lock element may be parallel to the second engagement surface.

In some configurations, the cable has an inner side and an outer side formed on an opposite side of the cable from the inner side, a distance from the inner side to the outer side defining a width of the cable. Here, the inner side may face the first lock element and the second lock element, and the outer side may face the first engagement surface and the second engagement surface. The cable may have a top end and a bottom end disposed on an opposite end of the cable from the top end. A distance from the top end of the cable to the bottom end of the cable defining a height of the cable, the height being less than a height of the first lock element and the second lock element. The height of the cable may be greater than the width of the cable. The inner side may be substantially straight from the top end to the bottom end and the outer side may be substantially straight from the top end to the bottom end.

In some implementations, the cable lock includes a biasing spring operable to apply a biasing force and to bias the locking member toward a locked state. The cable lock may also include a release cord attached to the locking member and operable to move the locking member from the locked state to an unlocked state when a tensile force exceeding the biasing force of the biasing spring is applied to the release cord in an unlocking direction. Here, the release cord may be attached to the locking member at an opposite end of the locking member than the biasing spring. An article of footwear may include the cable lock described above.

Another aspect of the disclosure provides a locking member for a cable lock. The locking member includes a first lock element extending along a direction from a first end of the locking member to a second end of the locking member. The first lock element includes a first series of teeth and a second series of teeth in parallel with the first series of teeth. The locking member also includes a second lock element extending along the direction from the first end of the locking member to the second end of the locking member and formed on an opposite side of the locking member from the first lock element. The second lock element includes a third series of teeth and a fourth series of teeth in parallel with the third series of teeth.

This aspect of the disclosure may include one or more of the following optional features. In some examples, the locking member includes a bottom surface and a top surface formed on an opposite side of the locking member from the bottom surface, the first series of teeth and the third series of teeth extending adjacent to the bottom surface, and the second series of teeth and the fourth series of teeth extending adjacent to the top surface. The first series of teeth may be staggered from the second series of teeth, and the third series of teeth may be staggered from the fourth series of teeth. The first series of teeth may define a first series of recesses, the teeth of the second series of teeth being aligned with the first series of recesses. The third series of teeth may define a second series of recesses, the teeth of the fourth series of teeth being aligned with the second series of recesses.

In some configurations, each of the first lock element and the second lock element is formed at an oblique angle to a longitudinal axis of the locking member. Here, the oblique angle may range from 2 degrees to 12 degrees. Optionally, the oblique angle may range from 4 degrees to 8 degrees or the oblique angle may be 6 degrees. An article of footwear may include the locking member as described above.

Yet another aspect of the disclosure proves a method of forming a locking member. The method includes forming a locking member blank having a first thickness. The locking member blank includes (i) a first portion including a first lock element and a second lock element formed on an opposite side of the first portion from the first lock element, (ii) a second portion including a third lock element and a fourth lock element formed on an opposite side of the second portion from the third lock element, and (iii) an intermediate portion connecting the first portion and the second portion. The method also includes bending the locking member blank along the intermediate portion to fold the first portion upon the second portion. The first lock element and the third lock element are arranged in parallel with each other and the second lock element and the fourth lock element are arranged in parallel with each other.

Implementations of this aspect of the disclosure may include one or more of the following optional features. In some implementations, forming the locking member blank includes forming each of the first lock element, the second lock element, the third lock element, and the fourth lock element with a series of teeth, each of the series of teeth defining a corresponding series of recesses disposed between adjacent ones of the teeth. Here, bending the locking member blank may include aligning the series of teeth of the first lock element with the series of recesses of the third lock element and aligning the series of teeth of the second lock element with the series of recesses of the fourth lock element.

In some examples, the method includes deburring the locking member blank. The locking member blank may be formed of a metal. Optionally, the locking member blank may be formed of an aluminum alloy. Forming the locking member blank may include stamping the locking member blank in a progressive die.

Figure 2:
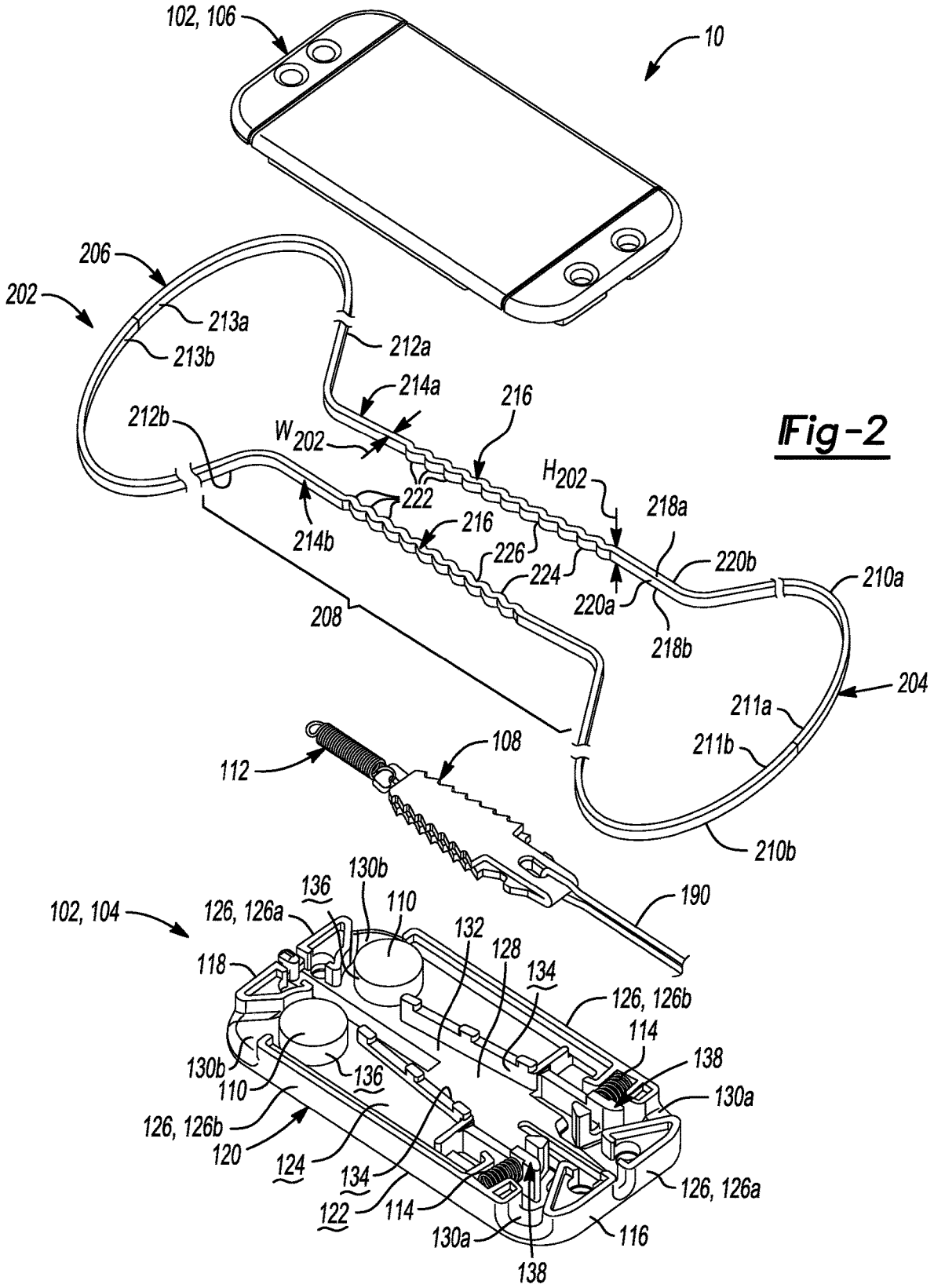
FIG. 2 is an exploded view of the cable lock of FIG. 1 showing a housing and a locking member of the cable lock.

With reference to FIGS. 1 and 2, a fastening system 10 including a cable lock 100 and a cable 202 is shown. Generally, the cable lock 100 is configured to interface with the cable 202 to adjust and secure a fit of an article when worn by a user. For example, the cable lock 100 and the cable 202 may be incorporated as part of a tensioning system 200 in an article of footwear 1000 (FIGS. 11-14) for dynamically adjusting and securing the fit of the article of footwear on the foot of the wearer. In other examples, the cable lock 100 and the cable 202 may be used with other articles, such as vests, helmets, or other articles where a dynamically-adjustable fit is desirable.

Referring to FIG. 2, the cable lock 100 includes an enclosure 102 having a housing 104 and a cover 106, and a lock or locking member 108 disposed within the enclosure 102 configured to selectively engage the cable 202. The cable lock 100 further includes a first biasing member 112 configured to bias the locking member 108 towards an engaged or locked position, and a pair of second biasing members 114 configured to cooperate with the housing 104 to retain the locking member 108 in a disengaged or unlocked position, as described below with respect to FIGS. 4B and 5B.

With reference to FIGS. 1 and 2, the housing 104 defines a length extending between a first end 116 and a second end 118. The housing 104 includes a base portion 120 having an outer surface 122 and a cable-receiving inner surface 124 formed on an opposite side of the base portion 120 from the outer surface 122. A peripheral wall 126 extends from the inner surface 124 and cooperates with the base portion 120 and the cover 106 to define a main cavity 128 of the enclosure 102, configured to receive the cable 202 and the locking member 108. In the illustrated example, the peripheral wall 126 includes a pair of end walls 126*a* at each of the first end 116 and the second end 118, and an opposing pair of sidewalls 126*b* extending between the end walls 126*a* to define a substantially rectangular housing 104.

The peripheral wall 126 may include a plurality of cable openings 130*a*, 130*b* formed therethrough for providing communication between the main cavity 128 and an exterior of the enclosure 102. In the illustrated example, the openings 130*a*, 130*b* include a first pair of openings 130*a* proximate to the first end 116 for receiving a first end of the cable 202, and a second pair of openings 130*b* proximate to the second end 118 for receiving a second end of the cable 202. Although the openings 130*a*, 130*b* of the illustrated example are shown as being formed through corners of the enclosure 102, the openings 130*a*, 130*b* may be formed entirely in the end walls 126*a* or entirely in the sidewalls 126*b*.

With continued reference to the cable lock 100, the housing 104 includes a locking chamber 132 defined by an opposing pair of locking or engagement surfaces 134 that converge toward one another such that the locking chamber 132 is associated with a wedge-shaped configuration tapering from the first end 116 toward the second end 118 of the housing 104. Accordingly, the engagement surfaces 134 are defined by corresponding sidewalls of the housing 104 converging toward one another and extending in a direction from the inner surface 124 of the base portion 120 to the cover 106 to define the locking chamber 132. As described in greater detail below, the engagement surfaces 134 cooperate with the locking member 108 to secure the cable 202.

The housing 104 includes cable guides 110 extending from the inner surface 124 of the base portion 120. The cable guides 110 each include a guide surface 136 along which the cable 202 may pass from the locking chamber 132 to either one of the openings 130*b* at the second end 118. In the illustrated example, the cable guides 110 are fixed members, formed integrally with the base portion 120. However, in other examples, the cable guides 110 may be formed separately from the housing 104 and/or may be rotatable.

Figure 3:
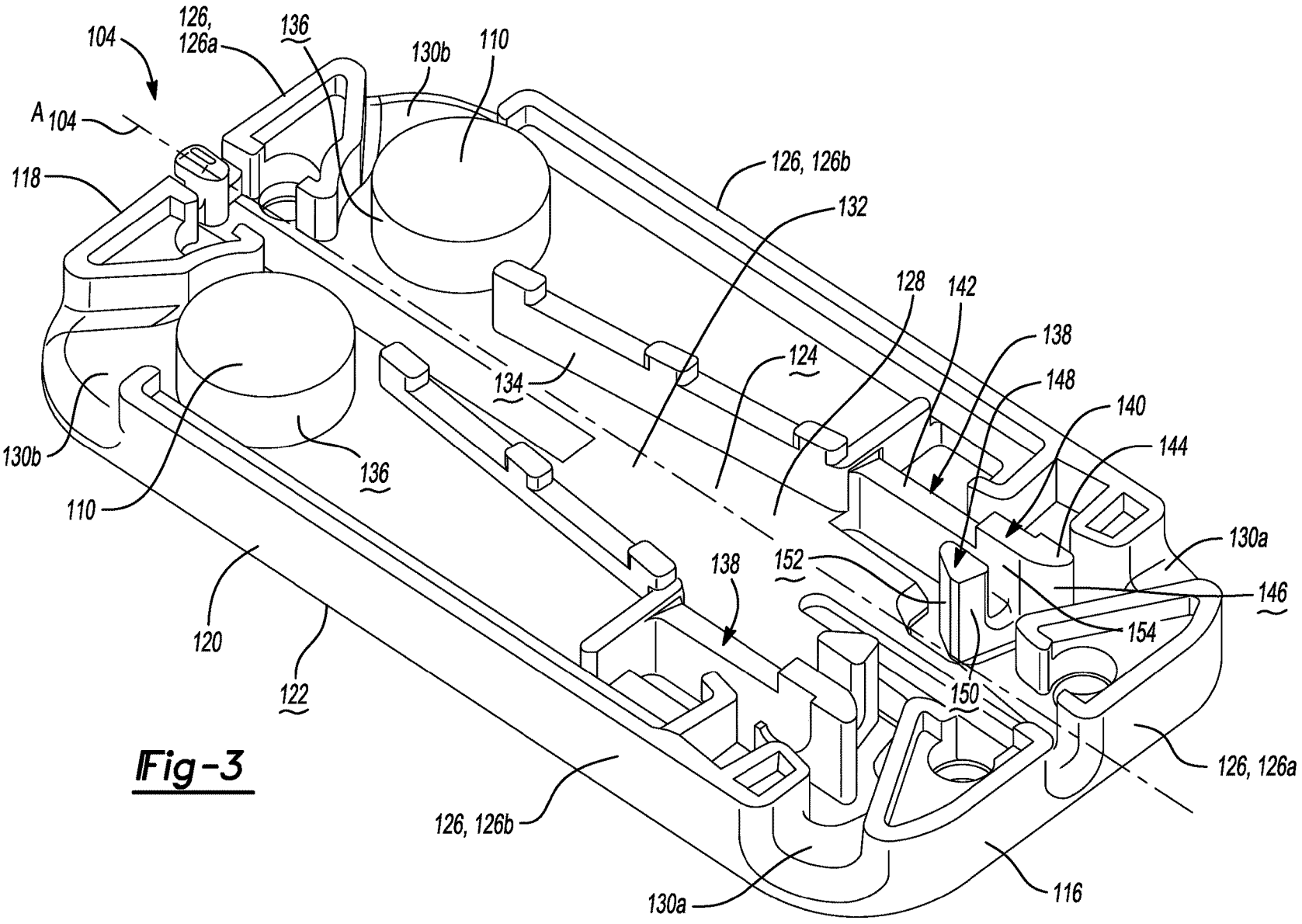
FIG. 3 is a perspective view of the housing of the cable lock of FIG. 1.
Figure 4A:
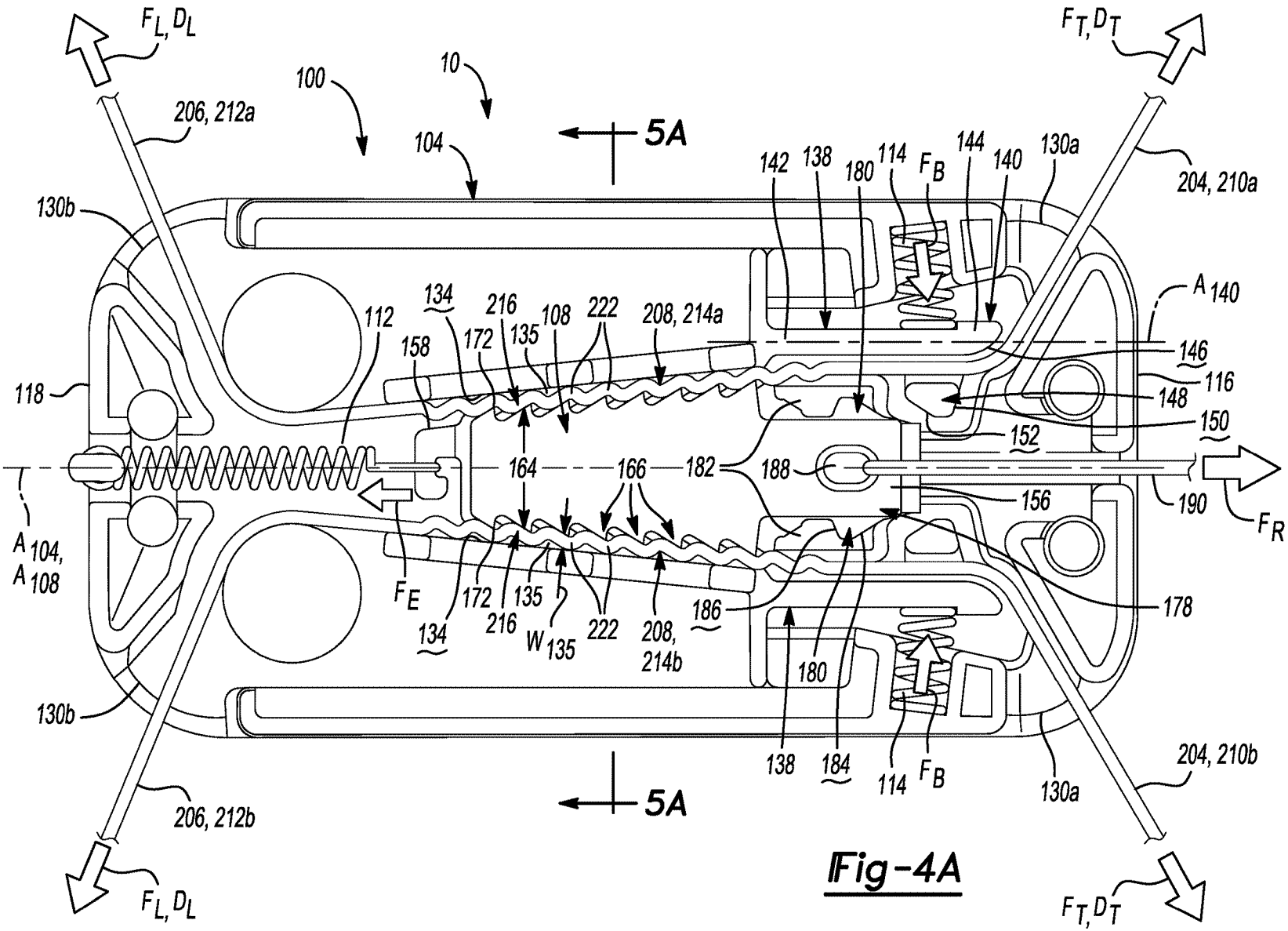
FIG. 4A is a top view of the cable lock of FIG. 1, showing the housing having a lid removed to expose the locking member slidably disposed within the housing when the locking member is in a locked position.
Figure 4B:
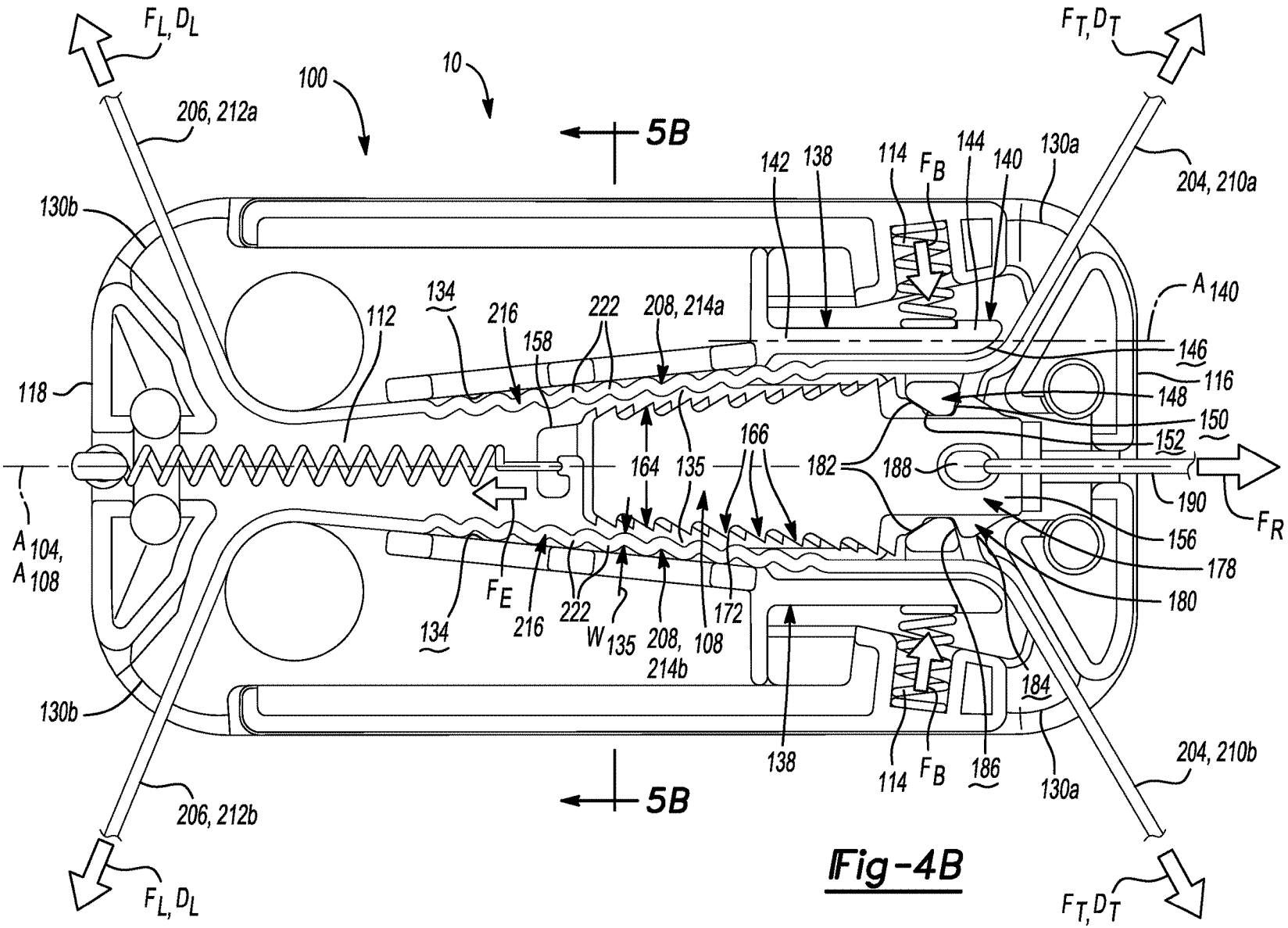
FIG. 4B is a top view of the cable lock of FIG. 1 showing the housing having the lid removed to expose the locking member slidably disposed within the housing when the locking member is in an unlocked position.
Figure 5A:
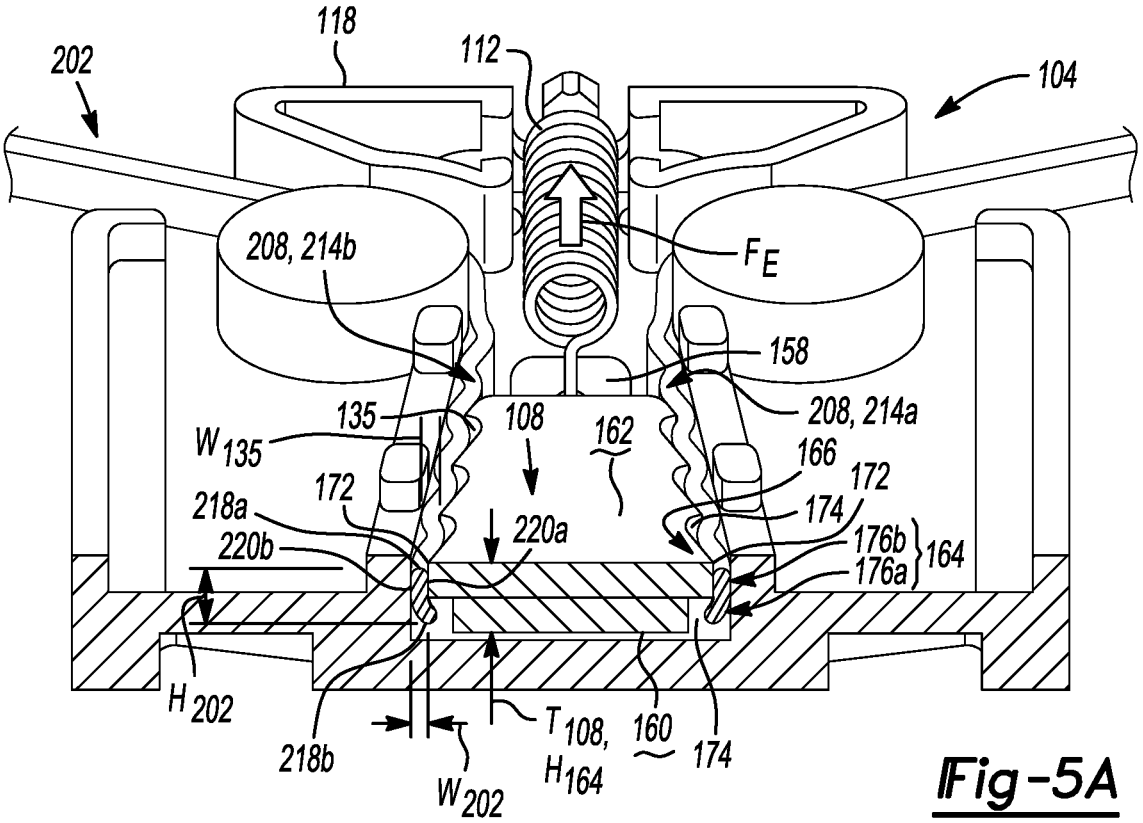
FIG. 5A is a cross-sectional view of the cable lock of FIG. 1 taken along section line 5A-5A of FIG. 4A, and showing an interface between the locking member, the cable, and the housing when the locking member is in the locked position.
Figure 5B:
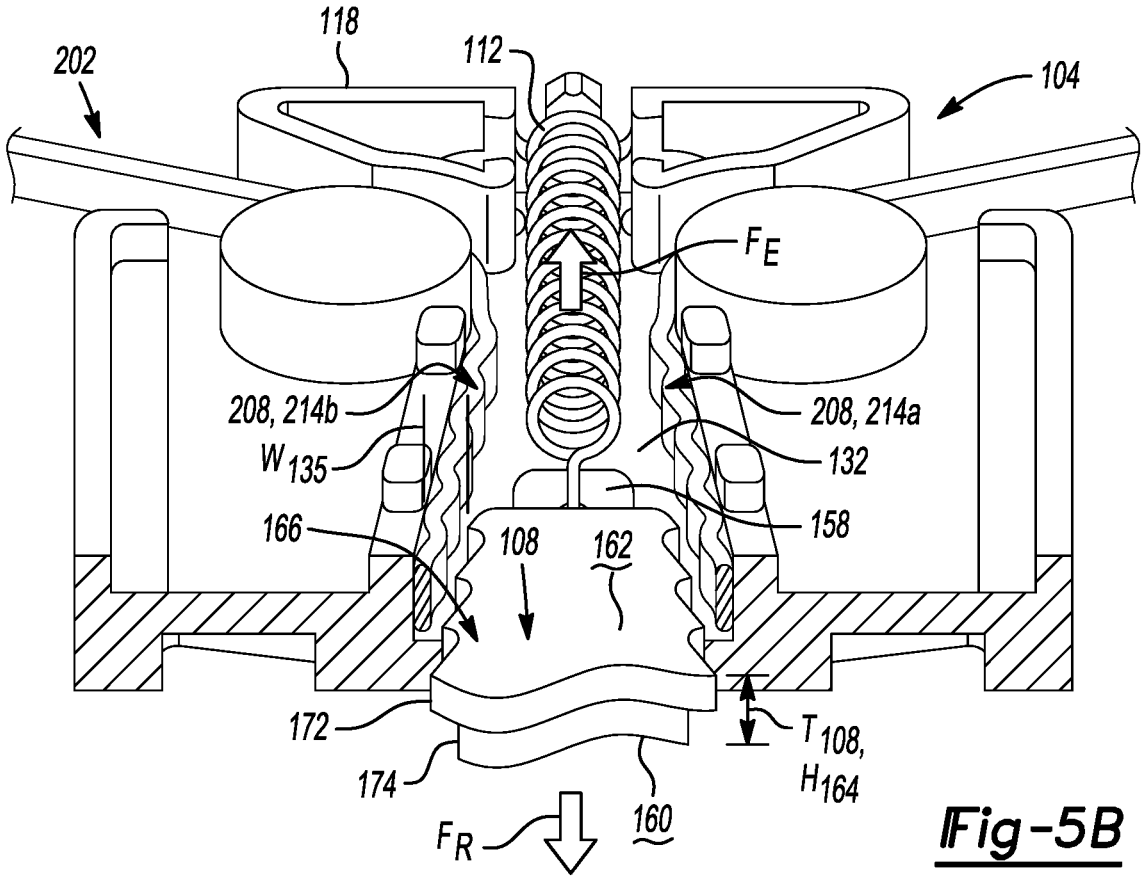
FIG. 5B is a cross-sectional view of the cable lock of FIG. 1 taken along section line 5B-5B of FIG. 4B, and showing an interface between the locking member, the cable, and the housing when the locking member is in the locked position.

With reference to FIG. 3, the housing 104 includes a pair of retention features 138 configured to selectively engage the locking member 108 and to secure the locking member 108 in the unlocked position, as shown in FIGS. 4B and 5B. The housing 104 may include two retention features 138 disposed on opposite sides of the housing 104, whereby the retention features 138 are biased inward toward the locking member 108. The retention features 138 are configured to be biased by the second biasing members 114. In the illustrated example, the retention features 138 each include a flexible tab 140 integrally formed with the housing 104 such that the retention features 138 act as living hinges movable between an engaged state and a disengaged state for allowing the locking member 108 to pass therebetween. Accordingly, each tab 140 extends along a longitudinal axis $A_{140}$ from a fixed first end 142 to a detached distal end 144. As shown, the distal ends 144 of each tab 140 may partially define a path of the cable 202 between the locking chamber 132 and the openings 130*a* at the first end 116 of the housing 104. Accordingly, the distal end 144 may include a convex inner guide surface 146 along which the cable 202 passes between the locking chamber 132 and a respective one of the first openings 130*a*.

Each of the retention features 138 further includes a projection 148 extending laterally into the locking chamber 132 from the distal end 144 of the tab 140. A width of the projection 148 may taper along a direction from the first end 116 to the second end 118, such that the projection 148 includes a retention surface 150 facing the first end 116 of the housing 104 and a biasing surface 152 formed on the opposite side of the projection 148 from the retention surface 150. Each of the retention surface 150 and the biasing surface 152 may be formed at an oblique angle with respect to a longitudinal axis $A_{104}$ of the housing 104. However, an angle of the retention surface 150 with respect to the longitudinal axis $A_{104}$ may be greater than the angle of the biasing surface 152, such that the retention surface 150 is configured to provide greater resistance to movement of the locking member 108 towards the second end 118 (i.e. the locked state) than towards the first end 116 (i.e. the unlocked state). In the illustrated example, the projection 148 is spaced apart from the distal end 144 of the tab 140, and cooperates with the distal end 144 to define a track 154 or passage for guiding the cable 202 from the locking chamber 132 to one of the first openings 130*a*.

With reference to FIGS. 4A and 4B, the cable lock 100 includes a pair of the second biasing members 114 configured to bias the distal ends 144 of the tabs 140 and, consequently, the projections 148 of the retention features 138, inwards toward the locking chamber 132. In the illustrated example, the biasing members 114 are compression springs that apply a continuous biasing force $F_B$ to the distal ends 144 of the tabs 140. In other examples, the biasing force $F_B$ may be applied by other types of biasing members 114, such as tension springs, coil springs, or by forming the first end 142 of the tab 140 as a resilient living hinge.

Figure 6A:
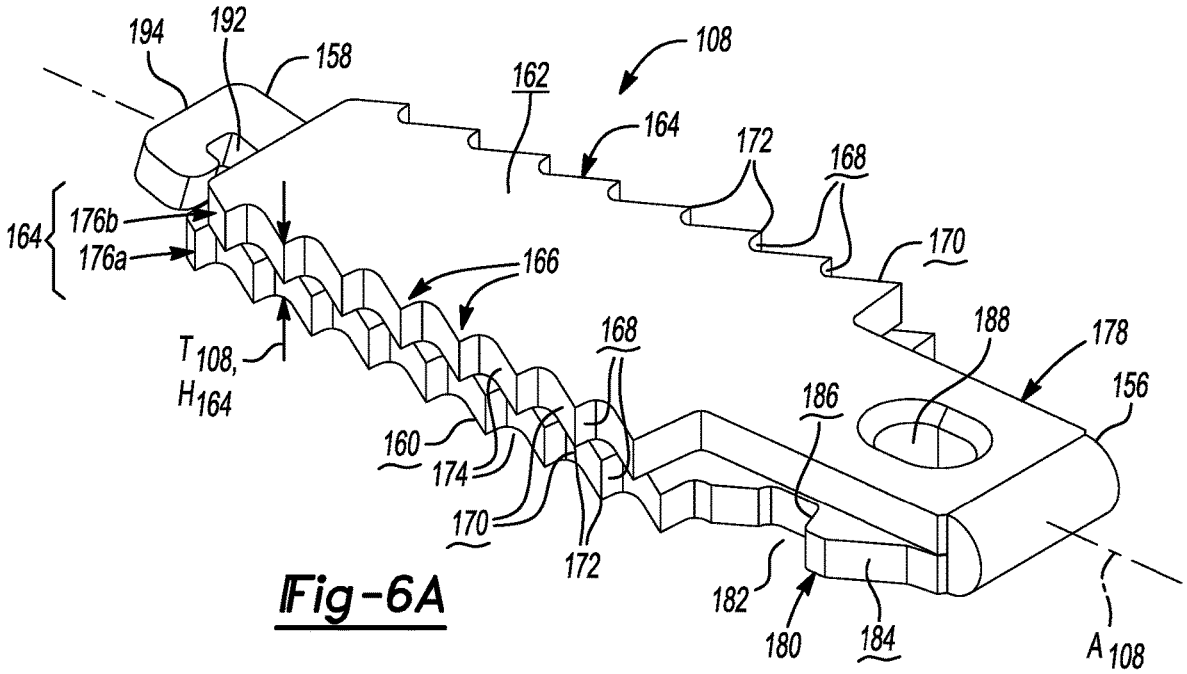
FIGS. 6A and 6B are perspective views of the locking member of the cable lock of FIG. 1.
Figure 6B:
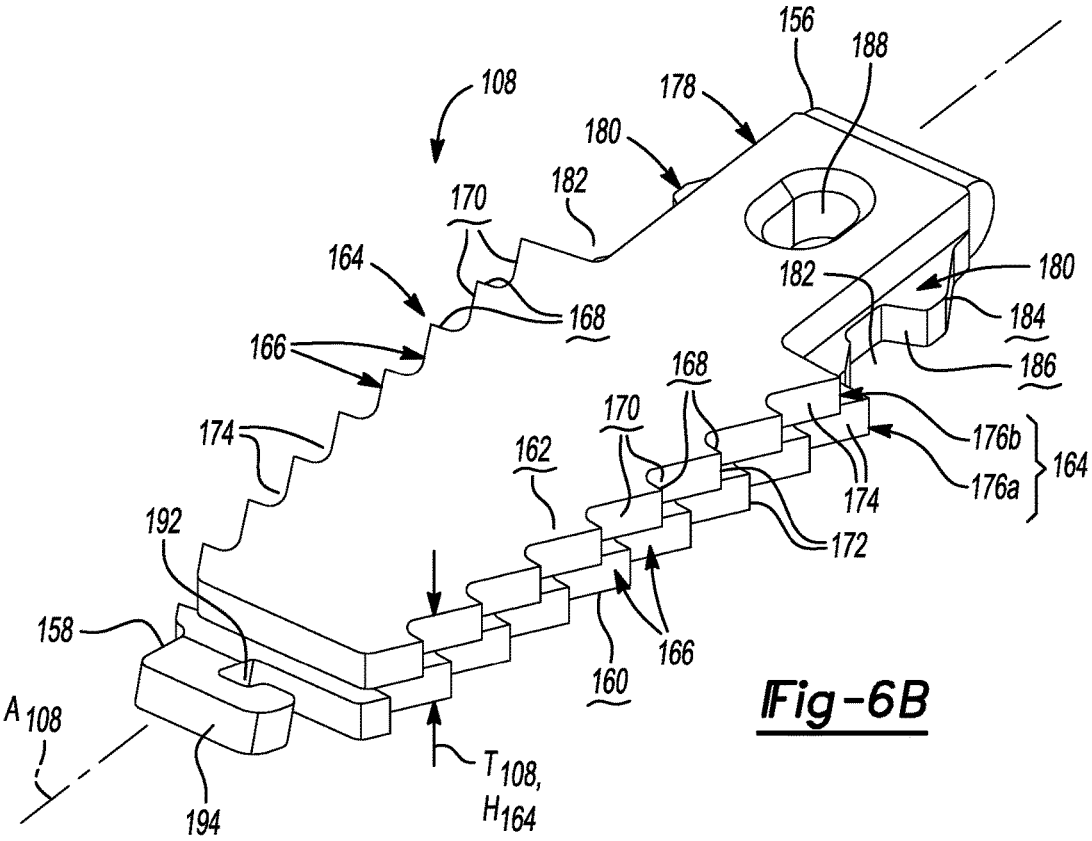

The locking member 108 is configured to be slideably received within the locking chamber 132 of the housing 104. As provided above, the locking member 108 is operable between a locked state and an unlocked state to selectively secure the cable 202 relative to the housing 104. Referring to FIGS. 6A and 6B, the locking member 108 extends along a longitudinal axis $A_{108}$ from a first end 156 to a second end 158 disposed at the opposite end from the first end 156. The locking member 108 further includes a bottom surface 160 configured to interface with the inner surface 124 of the base portion 120 and a top surface 162 formed on an opposite side of the locking member 108 from the bottom surface 160. A distance between the bottom surface 160 and the top surface 162 defines a thickness $T_{108}$.

With reference to FIGS. 6A-7B, a pair of lock elements 164 are formed between the bottom surface 160 and the top surface 162 on opposite sides of the locking member 108. The lock elements 164 each extend along a respective longitudinal axis $A_{164}$ from the first end 156 and the second end 158 of the locking member 108. As shown, the longitudinal axis $A_{164}$ of each of the lock elements 164 is formed at an oblique angle θ relative to the longitudinal axis $A_{108}$ of the locking member 108. Thus, in some examples, the lock elements 164 converge toward one another along a direction from the first end 156 to the second end 158, such that the lock elements 164 are parallel to and oppose respective ones of the engagement surfaces 134 of the housing 104 when the locking member 108 is disposed within the locking chamber 132.

The angle θ of the lock elements 164 is selected such that the cable 202 will transfer a sufficient portion of the tightening force $F_T$ (as shown in FIG. 4A) upon the lock elements 164 when the tightening force $F_T$ is applied to the cable 202 to overcome an engaging force $F_E$ of the first biasing element 112. Thus, application of the tightening force $F_T$ to the cable 202 will cause the locking member 108 to move along the longitudinal axis $A_{104}$ of the housing 104, away from the first biasing element 112. If the angle θ is too great, the locking elements 164 may cause the cable 202 to bind within the housing 104. However, too small of an angle θ will allow the cable 202 to pass freely along the locking elements 164 without imparting the necessary portion of the tightening force $F_T$ to the locking element 108. The angle θ may range from 2 degrees to 12 degrees, and more particularly, from 4 degrees to 8 degrees. In a particular example, the angle θ is 6 degrees.

In FIGS. 6A-7A, the lock elements 164 include a plurality of outwardly-protruding teeth 166 configured to permit movement by the cable 202 towards the first end 116 of the housing 104 while restricting movement by the cable 202 towards the second end 118 of the housing 104 by gripping the cable 202 when the locking member 108 is in the locked state. In the illustrated example, each of the teeth 166 includes a locking surface 168 facing the first end 156 of the locking member 108 and a trailing surface 170 facing the second end 158 of the locking member 108. As best shown in FIGS. 6A and 6B, the locking surface 168 and the trailing surface 170 of each tooth 166 intersect with each other to form a tip 172 of the tooth 166, while opposing (i.e., facing each other) locking and trailing surfaces 168, 170 of adjacent ones of the teeth 166 cooperate to define recesses 174 between the adjacent teeth 166.

Figure 7A:
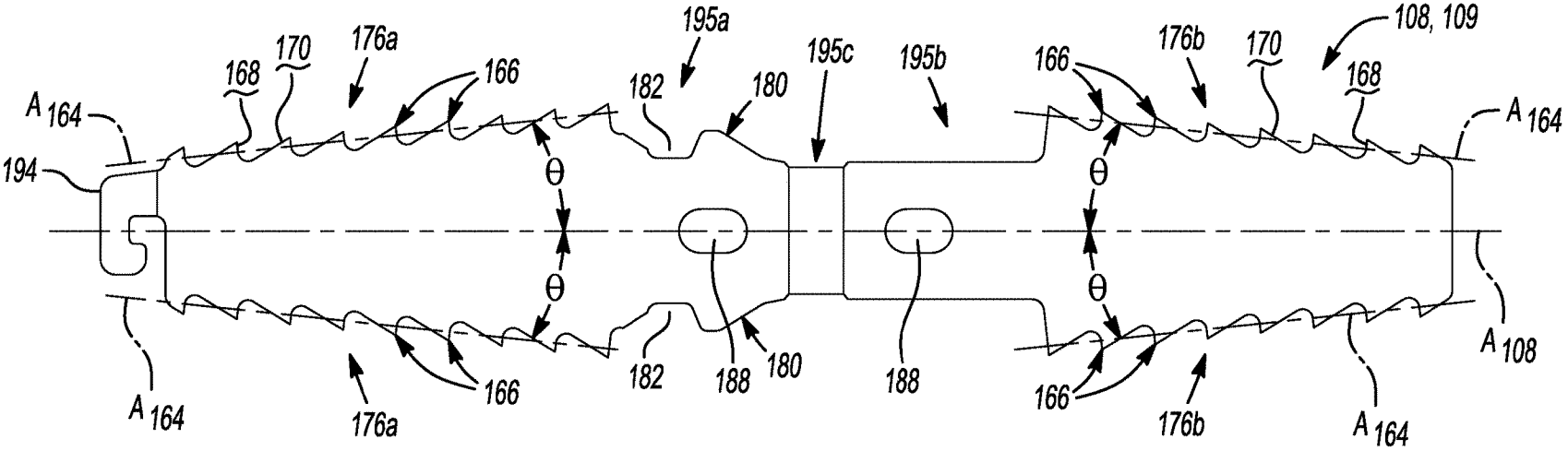
FIGS. 7A-7C illustrate steps for forming the locking member of FIGS. 6A and 6B.
Figure 7B:
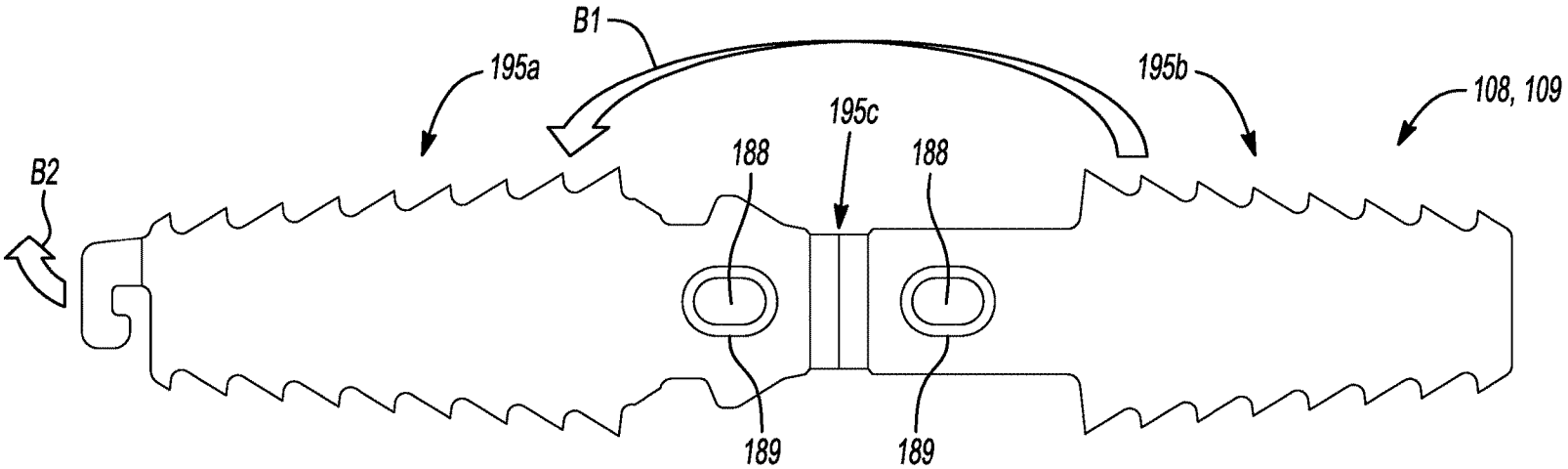
Figure 7C:
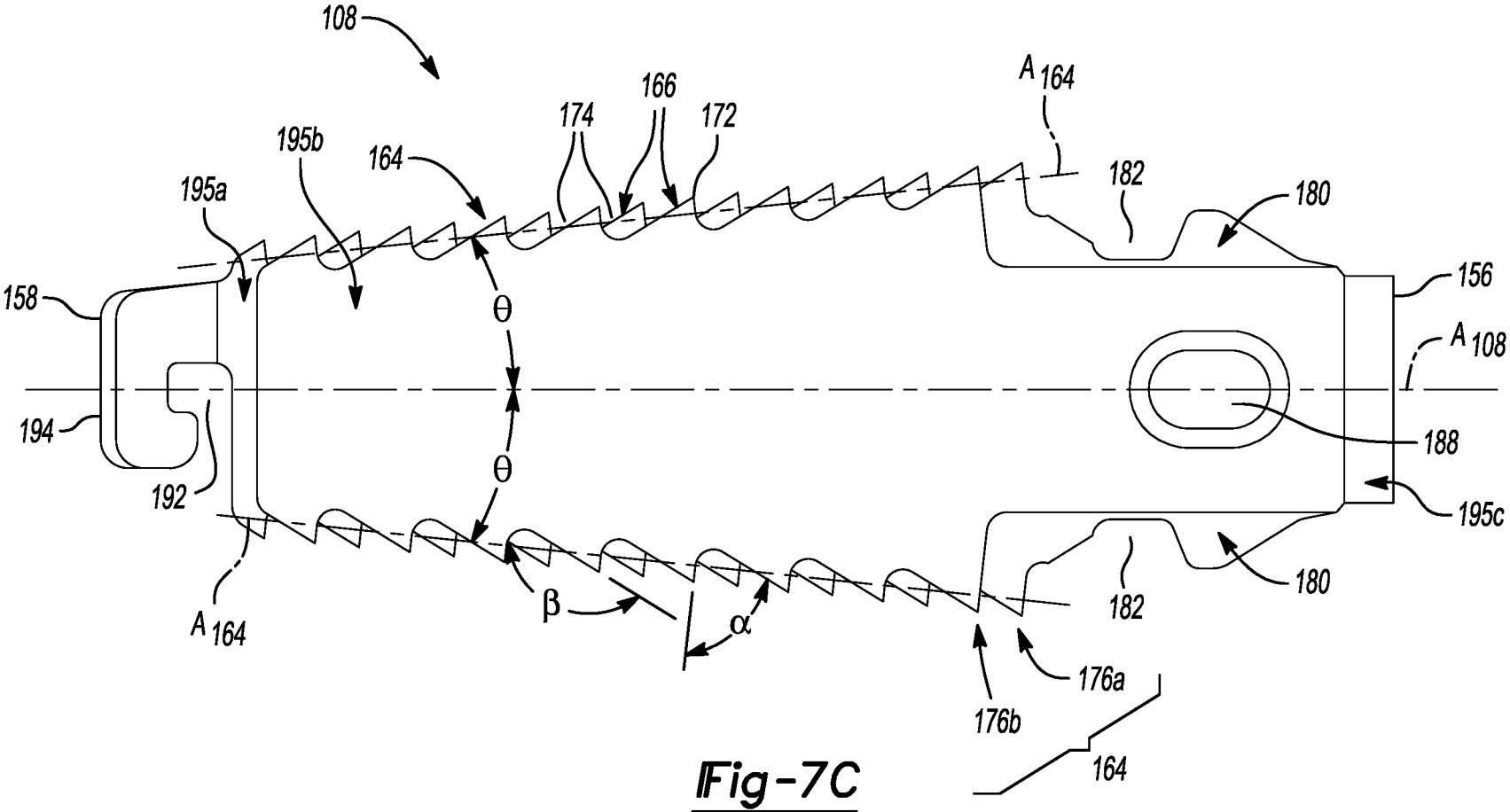
Figure 8:
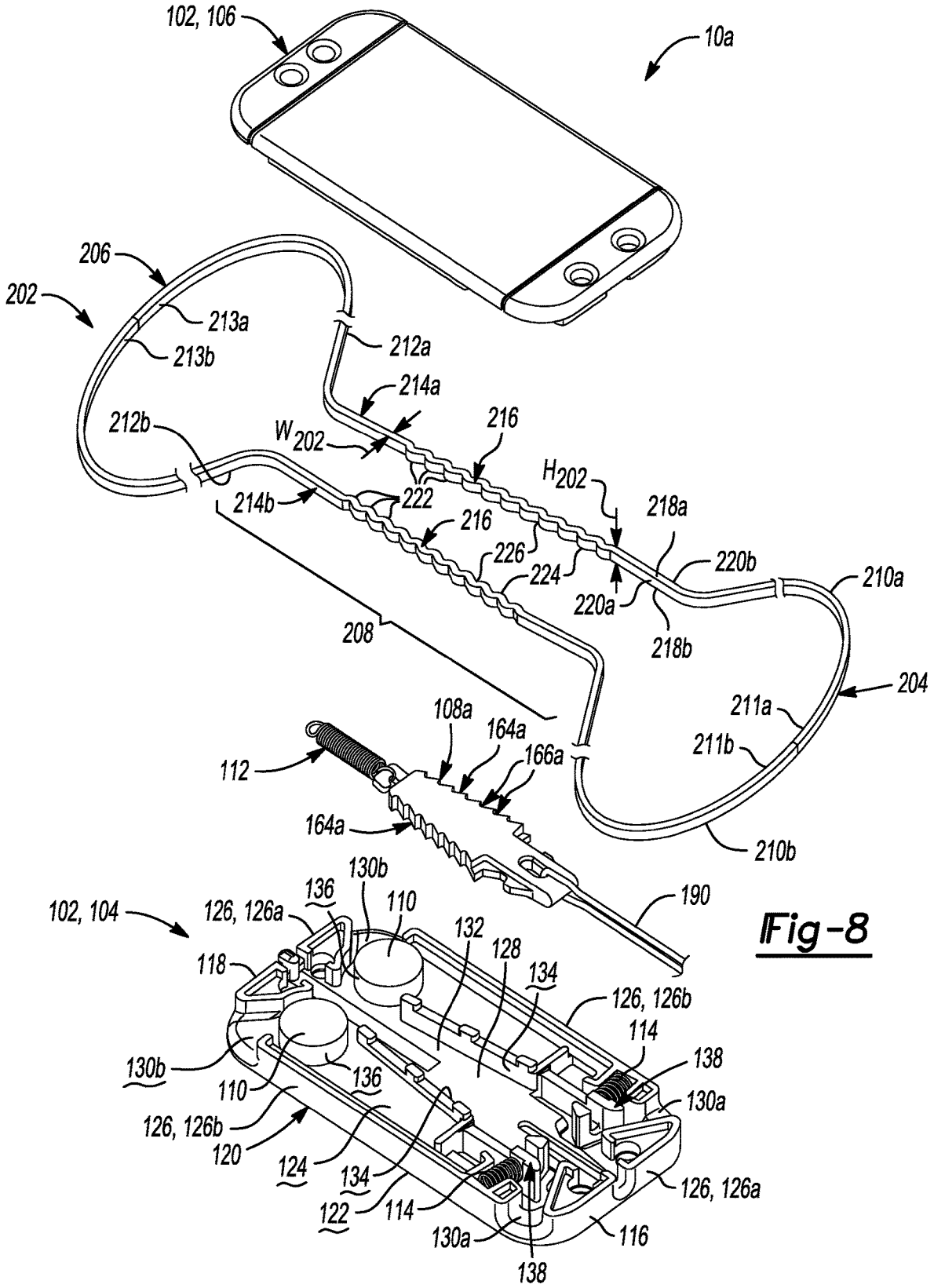
FIG. 8 is an exploded view of another cable lock according to the principles of the present disclosure.
Figure 9A:
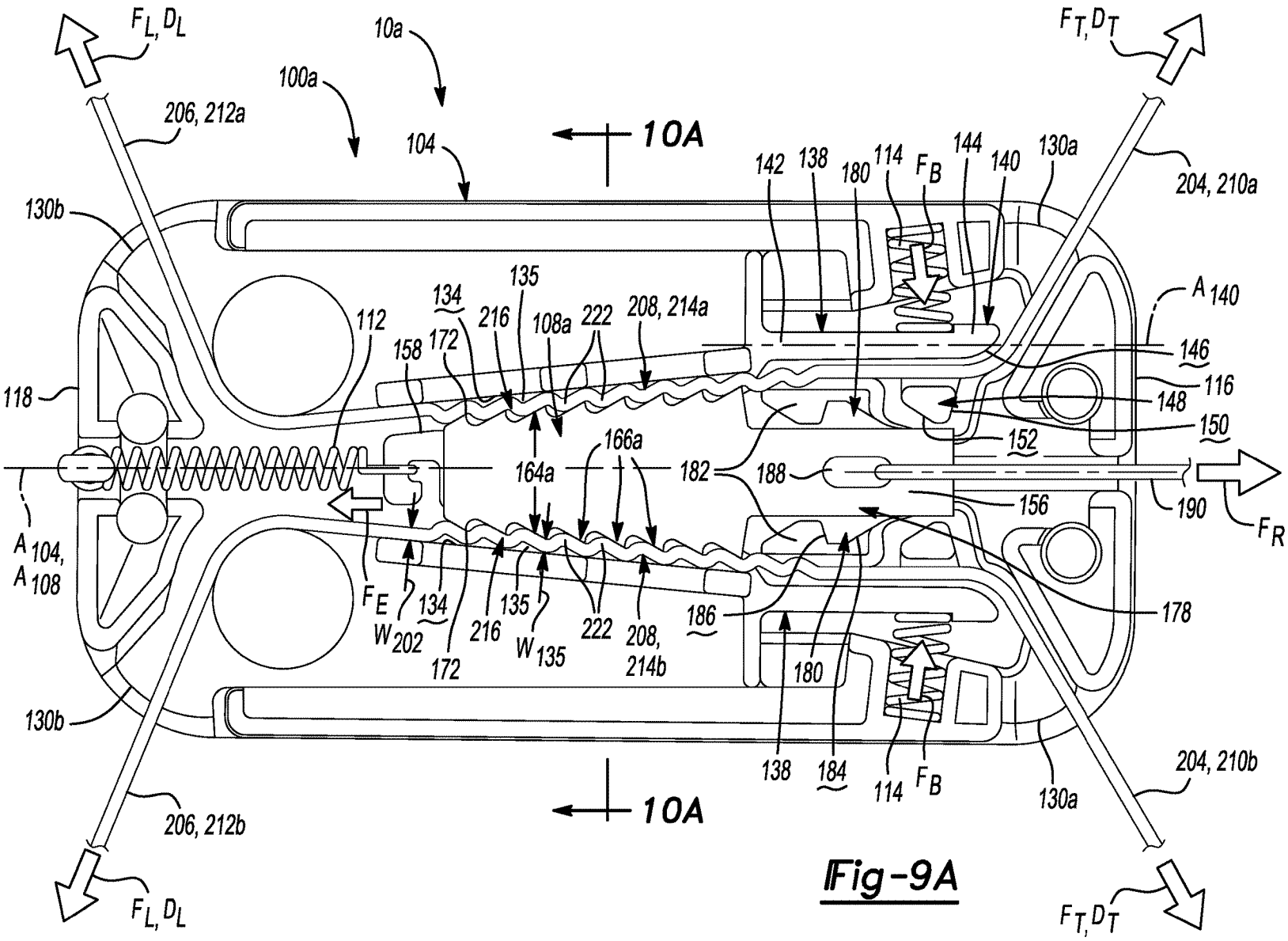
FIG. 9A is a top view of the cable lock of FIG. 8, showing the housing having a lid removed to expose the locking member slidably disposed within the housing when the locking member is in a locked position.
Figure 9B:
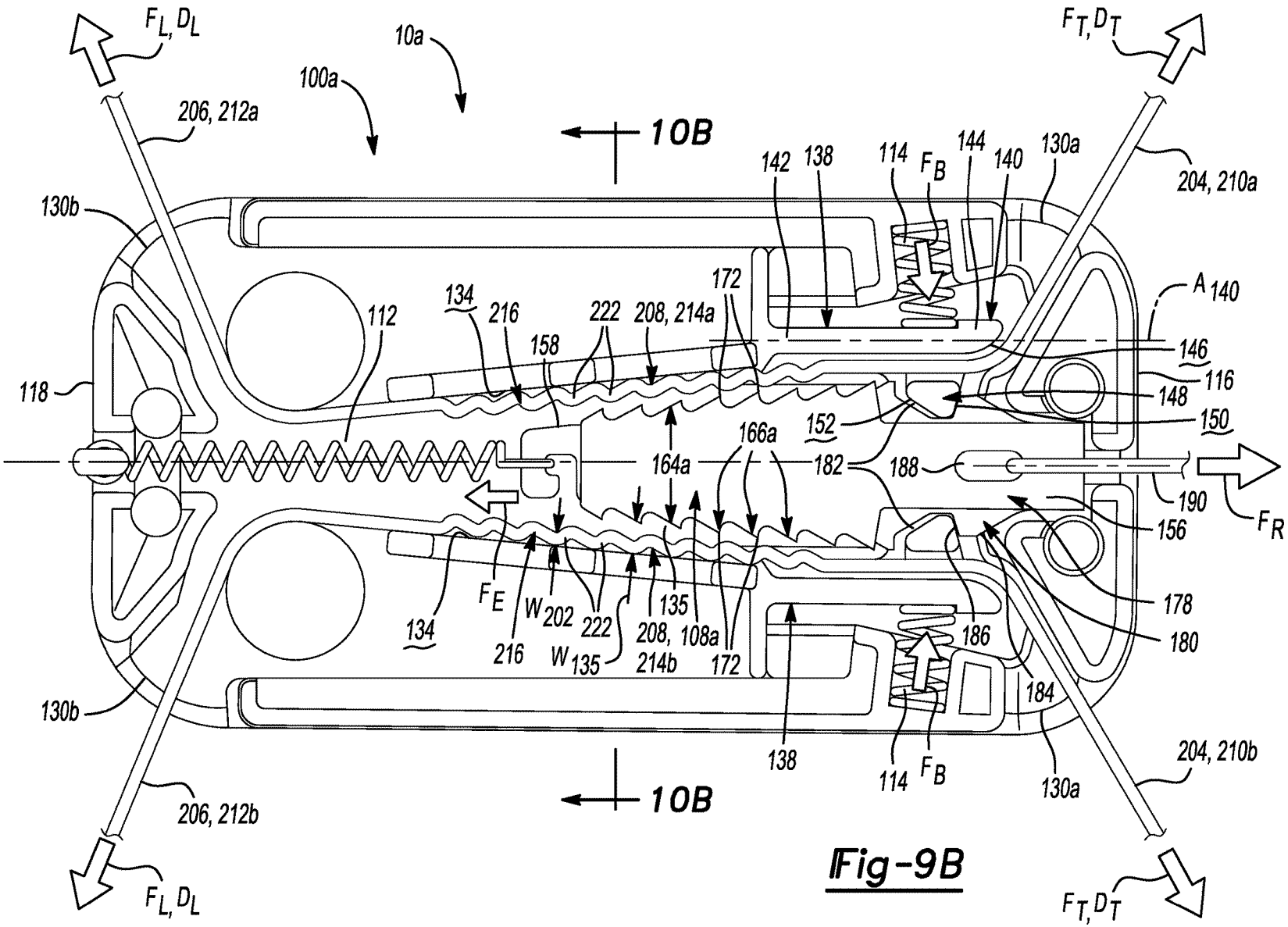
FIG. 9B is a top view of the cable lock of FIG. 8 showing the housing having the lid removed to expose the locking member slidably disposed within the housing when the locking member is in an unlocked position.
Figure 10A:
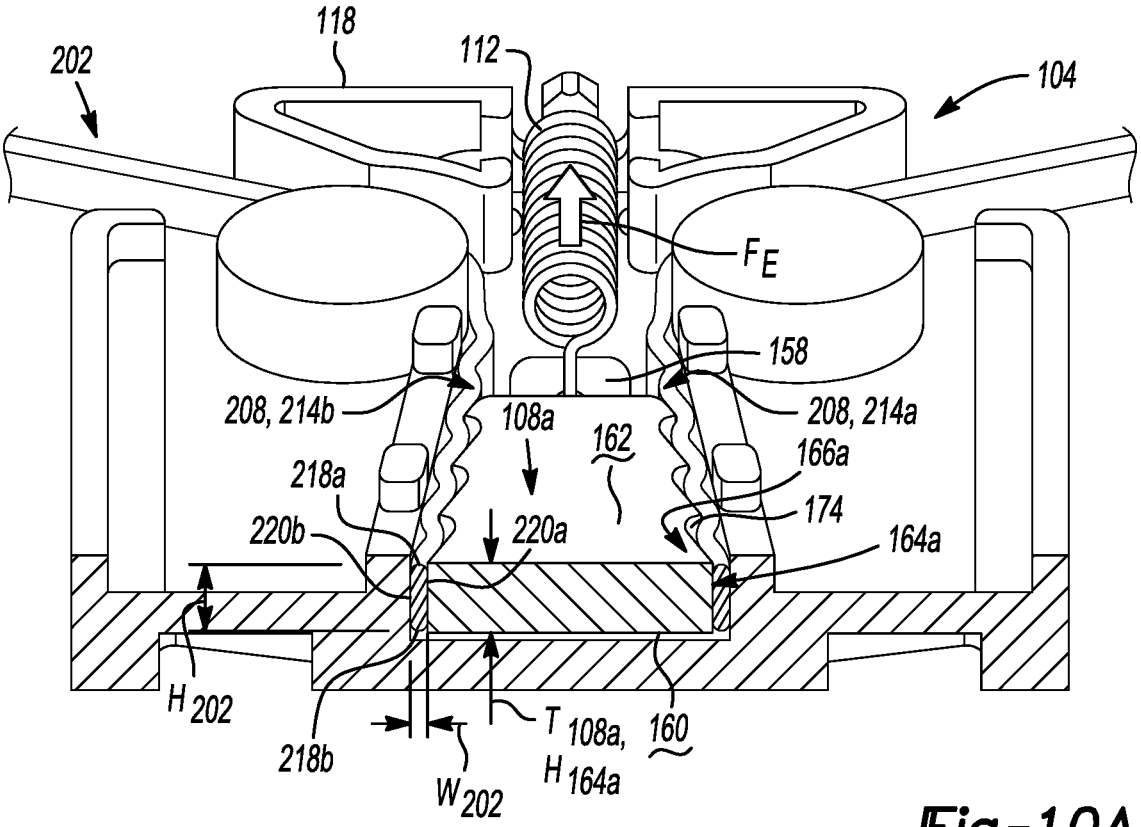
FIG. 10A is a cross-sectional view of the cable lock of FIG. 8 taken along section line 10A-10A of FIG. 9A, and showing an interface between the locking member, the cable, and the housing when the locking member is in the locked position.
Figure 10B:
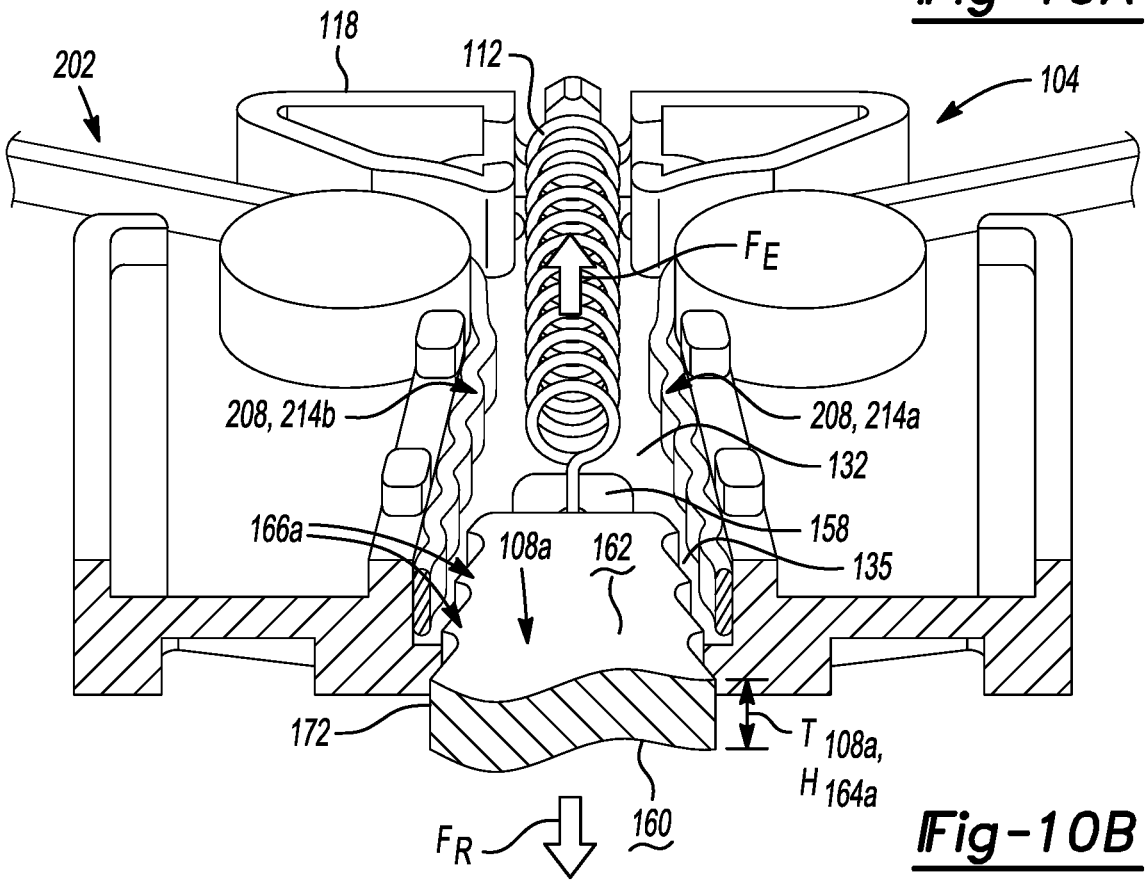
FIG. 10B is a cross-sectional view of the cable lock of FIG. 8 taken along section line 10B-10B of FIG. 9B, and showing an interface between the locking member, the cable, and the housing when the locking member is in the locked position.

Referring to FIG. 7C, each of the locking surface 168 and the trailing surface 170 may be formed at an angle with respect to a longitudinal axis $A_{164}$ of the lock element 164. As shown, an angle α of the locking surface 168 with respect to the longitudinal axis $A_{164}$ of the lock element 164 may be perpendicular or acute, such that the locking surface 168 will engage the cable 202 to prevent movement of the cable 202 in the loosening direction $D_L$ when the locking member 108 is in the locked position (FIGS. 4A and 5A). An angle β of the trailing surfaces 170 with respect to the longitudinal axis $A_{164}$ of the lock element 164 is obtuse, such that the cable 202 is able to slide over the trailing surfaces 170 in the tightening direction $D_T$ regardless of whether the locking member 108 is in the locked position (FIGS. 4A and 5A) or the unlocked position (FIGS. 4B and 5B).

As discussed above, each of the lock elements 164 extends along a longitudinal axis $A_{164}$ parallel to the respective engagement surface 134 of the housing 104. As shown in FIGS. 4A-5B, the tips 172 of the teeth 166 face the engagement surfaces 134, where a space between the tips 172 of the teeth 166 and the engagement surfaces 134 defines a pair of locking channels 135. Accordingly, the widths $W_{135}$ of the locking channels 135 are defined by the distance between the engagement surfaces 134 and the tips 172 of the teeth 166. As such, the widths $W_{135}$ of the locking channels 135 are variable as the locking member 108 moves between the locked state (FIGS. 4A and 5A) and the unlocked state (FIGS. 4B and 5B). Particularly, in the locked state, the cable lock 100 is configured so that the widths $W_{135}$ of the locking channels 135 are slightly less than a width $W_{202}$ of the cable 202 to compress the cable 202 between the teeth 166 and the engagement surface 134. Movement of the locking member 108 may be limited in the direction towards the second end 118 of the housing 104 so that a minimum width $W_{135}$ is maintained. For example, a minimum width of one (1) millimeter may be suitable for a cable 202 having a width $W_{202}$ greater than one (1) millimeter.

As shown in FIGS. 6A and 6B, each of the lock elements 164 includes a lower first series 176*a* of the teeth 166 and an upper second series 176*b* of the teeth 166. In the illustrated example, the first series 176*a* extends along a lower portion of each lock element 164 adjacent to the bottom surface 160 and the second series 176*b* extends along an upper portion of the lock element 164 adjacent to the top surface 162, such that the first series 176*a* and the second series 176*b* are in a stacked arrangement along each lock element 164. Accordingly, although the first series 176*a* and the second series 176*b* may be described as extending in parallel, the first series 176*a* and the second series 176*b* are not necessarily parallel to each other geometrically. For example, the first series 176*a* and the second series 176*b* may be in parallel in a functional sense, but be arranged at an oblique angle relative to one another.

In the illustrated example, the first series 176*a* and the second series 176*b* are immediately adjacent to each other. Accordingly, the first series 176*a* and the second series 176*b* cooperate to define a height $H_{164}$ of the lock element 164, which is the same as the thickness $T_{108}$ of the locking member 108. However, in other examples, the first series 176*a* and the second series 176*b* may be spaced apart from each other and/or the respective surfaces 160, 162 of the locking member 108.

As shown in FIGS. 6A and 6B, the teeth 166 of the first series 176*a* of each lock element 164 are offset or staggered from the teeth 166 of the second series 176*b* of the respective lock element 164 in a direction extending along a length of the locking member 108, such that the tips 172 of the teeth 166 of the first series 176*a* are aligned with the recesses 174 of the second series 176*b* along a direction from the bottom surface 160 to the top surface 162. Likewise, the tips 172 of the teeth 166 of the second series 176*b* are aligned with the recesses 174 of the first series 176*a* along the direction from the bottom surface 160 to the top surface 162. Accordingly, the teeth 166 of one of the series 176*a*, 176*b* overhang the recesses of the other one of the series 176*a*, 176*b*, and vice versa. As discussed in greater detail below, this staggered configuration of teeth 166 and recesses 174 advantageously restricts movement of the cable 202 along the direction from the bottom surface 160 to the top surface 162, as the exposed edges of the teeth 166 between the bottom surface 160 and the top surface 162 cooperate to engage or grip the cable 202.

With continued reference to FIGS. 6A and 6B, the first end 156 of the locking member 108 may include a tab portion 178 having flared protuberances 180 extending outwardly therefrom, and a pair of detents 182 formed between the protuberances 180 and the lock elements 164. Generally, the protuberances 180 include a biasing surface 184 facing toward the first end 156 of the locking member 108 and a retention surface 186 facing in an opposite direction from the biasing surface 184. The retention surface 186 defines a portion of the detent 182. The biasing surfaces 184 of the protuberances 180 are configured to interface with the biasing surfaces 152 of the retention features 138 to spread the projections 148 apart from each other as the protuberances 180 pass between the projections 148 when the locking member 108 is moved towards the first end 116 of the housing 104. The retention surfaces 186 of the protuberances 180 are configured to interface with the retention surfaces 150 of the retention features 138 to secure the locking member 108 in the unlocked state, as shown in FIG. 4B.

The locking member 108 may include a first aperture 188 at the first end 156 formed through the thickness $T_{108}$ of the locking member 108. Particularly, the first aperture 188 is formed through the tab portion 178 of the locking member 108 for attaching a release cord 190 of the cable lock 100. A second aperture 192 is formed through the second end 158 of the locking member 108, and is configured for attaching the first biasing member 112 to the locking member 108. In the illustrated example, the second aperture 192 is formed through a hook 194 disposed at the second end 158 of the locking member 108.

Referring now to FIGS. 7A-7C, steps for forming the locking member 108 are illustrated. Initially, as illustrated in FIG. 7A, the locking member 108 is formed as a locking member blank 109. The blank 109 includes a flat piece of material defining the features of the locking member 108 described above. In an initial stage, the blank 109 includes a first portion 195*a* formed at a first end of the blank 109, a second portion 195*b* formed at a second end of the blank 109, and an intermediate neck portion 195*c* disposed between and connecting the first portion 195*a* and the second portion 195*b*. The first portion 195*a* of the blank 109 includes the first series 176*a* of the teeth 166, the protuberances 180 and detents 182, a first portion of the first aperture 188, and the hook 194. The second portion 195*b* of the blank 109 includes the second series 176*b* of the teeth 166 and a second portion of the first aperture 188.

The blank 109 may be formed by cutting or stamping the blank 109 from a sheet of material. In some examples, the blank 109 is formed using a progressive die, where the features (e.g., teeth 166, protuberances 180) are progressively formed in a series of stamping operations. The material of the blank is selected to impart desired characteristics of durability, machinability, and malleability. For example, suitable materials are capable of withstanding the bending steps associated with forming the locking member without cracking, but have a hardness sufficient to minimize degradation of the features 166, 180 over a period of use. Aluminum alloys, such as AL5052, are examples of suitable materials.

A thickness of the material will be half of the finished thickness $T_{108}$ of the locking member 108, such that the thickness $T_{108}$ of the locking member 108 is obtained when the first portion 195*a* is folded onto the second portion 195*b*. Following formation of the blank 109, the blank 109 may be processed through a deburring and finishing step, where the blank 109 is treated to improve surface finish and remove excess material. Suitable processes for deburring and finishing may include abrasive and/or chemical processes, such as sandblasting, vibratory or tumbling finishing, sanding, filing, chemical treatments, or the like.

In another step, shown in FIG. 7B, the locking member blank 109 may be processed through one or more operations to transition the locking member blank 109 to the locking member 108. For example, the blank 109 may be processed through one or more machining processes to apply chamfers or rounded edges. As shown in FIG. 7B, peripheral edges 189 of the first aperture 188 may be machined to provide a transition between the bottom and top surfaces 160, 162 and the first aperture 188. The transition may be embodied as a radius or chamfer.

The blank 109 may also be processed through one or more bending steps to transition the blank 109 from a flat piece of material to the folded locking member 108. In one bending step B1, the first portion 195*a* of the blank 109 and the second portion 195*b* of the blank 109 are folded over upon each other by bending the blank 109 along the intermediate neck portion 195*c*. As discussed above, when the first portion 195*a* is folded over onto the second portion 195*b*, the first series 176*a* of teeth 166 formed on the first portion 195*a* are staggered or offset relative to the second series 176*b* of teeth 166 formed on the second portion 195*b*, as illustrated in FIG. 7C. Accordingly, the recesses 174 of the first portion 195*a* overlap the teeth 166 of the second portion 195*b*, and vice versa. Furthermore, the first portion of the first aperture 188 formed in the first portion 195*a* of the blank 109 is aligned with the second portion of the first aperture 188 formed in the second portion 195*b* of the blank 109 to define the continuous aperture 188 extending through the thickness $T_{108}$ of the locking member 108.

In another bending step B2, the hook 194 formed on the first portion 195*a* of the blank 109 may be bent away from the bottom surface 160 of the locking member 108. Accordingly, the second end 158 of the locking member 108, which is formed by a distal end of the hook 194, is positioned between the bottom surface 160 and the top surface 162.

Referring back to FIGS. 4A-5B, the locking member 108 includes the first biasing member 112 attached to the second end 158 and a release cord 190 attached to the first end 156. As shown, the first biasing member 112 is a tension spring having a first end attached to the second end 158 of the locking member 108 and a second end attached to the second end 118 of the housing 104. Accordingly, the first biasing member 112 is configured to apply a continuous engaging force $F_E$ to the locking member 108 to bias the locking member 108 towards the locked state. In some examples, the second end 158 of the locking member 108 is substantially centered between the bottom surface 160 and the top surface 162, such that an engaging force $F_E$ applied to the second end 158 of the locking member 108 by the first biasing member 112 is also centered between the bottom surface 160 and the top surface 162. Thus, the biasing force $F_E$ extends substantially parallel to the longitudinal axis $A_{108}$ of the locking member 108.

Conversely, the release cord 190 is attached to the tab portion 178 at the first end 156 of the locking member 108 and is configured to transmit a selectively-applied release force $F_R$ to the first end 156 of the locking member 108. As discussed above and below and illustrated in FIGS. 4B and 5B, when the release force $F_R$ is greater than the engaging force $F_E$, the locking member 108 will move from the locked state towards the unlocked state.

Referring now to FIG. 2, the cable 202 includes a control portion 204 extending from the first openings 130*a* formed proximate to the first end 116, a fastening portion 206 extending from the second openings 130*b*, and a locking portion 208 extending between the control portion 204 and the fastening portions 206. The control portion 204 is configured to have a tightening force $F_T$ applied thereto to move the cable 202 in the tightening direction $D_T$. When incorporated into the article of footwear 1000, the control portion 204 may be arranged on the article of footwear 1000 so that it can be easily grasped by a user to pull the cable 202 in the tightening direction $D_T$. The fastening portion 206 is configured to cooperate with a tracking system to tighten the article of footwear 1000 when the tightening force $F_T$ is applied to the control portion 204. Conversely, the fastening portion 206 is also configured to have a loosening force $F_L$ applied thereto to move the cable 202 in a loosening direction $D_L$. The locking portion 208 is disposed within the housing 104 and is configured to interface with the locking member 108 to secure the position of the cable 202 relative to the housing 104.

In some examples, each of the control portion 204 and the fastening portion 206 may be referred to as including a first segment 210*a*, 212*a* and a second segment 210*b*, 212*b*. For example, as shown in FIGS. 1 and 2, the control portion 204 may include a first control segment 210*a* extending from one of the first openings 130*a* to a first terminal end 211*a* and a second control segment 210*b* extending from the other one of the first openings 130*a* to a second terminal end 211*b*. Like the control portion 204, the fastening portion 206 may include a first fastening segment 212*a* extending from one of the second openings 130*b* to first terminal end 213*a* and a second fastening segment 212*b* extending from the other of the first openings 130*a* to a second terminal end 213*b*.

The first segments 210*a*, 212*a* may be connected to the respective second segments 210*b*, 212*b* such that each of the control portion 204 and the fastening portion 206 form continuous lengths of the cable 202 extending between the openings 130*a*, 130*b*. For example, the terminal ends 211*a*, 211*b* of the segments 210*a*, 210*b* of the control portion 204 and/or the terminal ends 213*a*, 213*b* of the segments 212*a*, 212*b* of the fastening portion 206 may be connected to each other to form a continuous loop. Alternatively, at least one of the control portion 204 and the fastening portion 206 may include separated first segments 210*a*, 212*a* and second segments 210*b*, 212*b*. For example, the terminal ends 211*a*, 211*b* of the control portion 204 and/or the terminal ends 213*a*, 213*b* of the fastening portion 206 be separated from each other and independently attached to the article of footwear 1000.

The locking portion 208 may also include first locking segment 214*a* and a second locking segment 214*b*. The first control segment 210*a* is connected to the first fastening segment 212*a* by a first locking segment 214*a*, and the second control segment 210*b* is connected to the second fastening segment 212*b* by the second locking segment 214*b*. Each of the first locking segment 214*a* and the second locking segment 214*b* are formed into lock elements 216 that interface with the lock elements 164 of the locking member 108 to secure a position of the cable 202 within the housing 104. As described in greater detail below, the lock elements 216 of the cable 202 are formed into the segments

214*a*, 214*b* by the teeth 166 and recesses 174 of the lock elements 164 of the locking member 108 when in the locked position. FIG. 2 illustrates the resulting structure of the segments 214*a*, 214*b* when engaged by the teeth 166 and recesses 174.

While an overall length of the cable 202 remains constant, effective lengths of the control portion 204 and the fastening portion 206 of the cable 202 depend upon the position of the cable 202 with respect to the cable lock 100. For example, when the control portion 204 is pulled and the cable 202 moves in the tightening direction $D_T$ through the cable lock 100, the effective length of the control portion 204 will increase and the effective length of the fastening portion 206 will decrease. Conversely, when the fastening portion 206 is pulled and the cable 202 moves in the loosening direction $D_L$ through the cable lock 100, the effective length of the fastening portion 206 will increase to loosen the article of footwear 1000 and the effective length of the control portion 204 will decrease. As provided above, the locking portion 208 refers to the portion of the cable 202 that is contained within the cable lock 100, regardless of the position of the cable 202. Accordingly, the effective lengths of the control portion 204, the fastening portion 206, and the locking portion 208 are not fixed sections of the cable 202 itself, but depend on the position of the cable 202 with respect to the cable lock 100.

With reference to FIGS. 2, 5A, and 5B, at least a portion of the cable 202 may be embodied as a "flat" cable, where a height $H_{202}$ of the cable 202 is greater than a width $W_{202}$ of the cable 202. Here, the cable 202 includes a top end 218*a* and a bottom end 218*b* formed on an opposite end of the cable 202 from the top end 218*a*. The cable 202 further includes an inner side 220*a* and an outer side 220*b* formed on an opposite side of the cable 202 from the inner side 220*a*. A distance between the ends 218*a*, 218*b* defines the height $H_{202}$ of the cable 202, while the distance between the sides 220*a*, 220*b* defines the width $W_{202}$ of the cable 202.

In the illustrated example, the sides 220*a*, 220*b* of the cable 202 are substantially straight from the top end 218*a* to the bottom end 218*b*, thereby providing the cable 202 with the substantially flat shape. Although the entire cable 202 is illustrated as embodying a substantially flat shape—having a height $H_{202}$ greater than a width $W_{202}$—in some examples one or more of the portions 204, 206, 208 may have a rounded or circular cross-sectional shape, while others of the portions 204, 206, 208. For example, the locking portion 208 may be formed with the flat shape, while the control portion 204 and the fastening portion 206 are rounded or circular.

Forming the cable 202, or at least the locking portion 208 of the cable 202, to have a relatively flat shape with a height $H_{202}$ greater than a width $W_{202}$ offers several benefits. For example, proper tracking of the flat cable 202 is more easily maintained through the housing 104, and particularly through the locking channels 135, as the sides 220*a*, 220*b* of the cable 202 are maintained in facing contact with the engagement surfaces 134 and the lock elements 164. Additionally, minimizing the width $W_{202}$ of the cable 202 consequently minimizes the distance that the locking member 108 must be moved to move the cable lock 100 to the unlocked state, as the width $W_{135}$ of the locking channel 135 need only be greater than the width $W_{202}$ of the cable 202 to allow movement of the cable 202 through the cable lock 100.

In the illustrated example, the lock elements 216 of the cable 202 include a plurality of undulations 222 formed along the length of the locking portion 208 of the cable 202 by the teeth 166 and the recesses 174. Here, a thickness or width $W_{202}$ of the cable 202 is substantially constant along the length of the locking portion 208 such that the cable 202 has a wave-like profile. Accordingly, opposite sides 220*a*, 220*b* of the cable 202 are substantially parallel to each other. Here, the cable 202 has a beaded profile including a series of alternating wider portions and narrower portions, whereby the wider portions are caused by the teeth 166 splaying the cable 202 at the wider portions, thereby securing a position of the cable 202 relative to the housing 104 when the cable lock 100 is in the locked position. Particularly, the undulations 222 form an alternating series of peaks 224 and valleys 226 along the lock elements 216, which cooperate with the teeth 166 of the locking member 108 to secure the cable 202.

With continued reference to FIGS. 5A and 5B, at least the locking portion 208 of the cable 202 is formed with a height $H_{202}$ that is less than the height $H_{164}$ of lock elements 164, whereby the top and bottom ends 218*a*, 218*b* of the cable 202 are respectively spaced inwardly from the top surface 162 and the bottom surface 160 of the locking member 108. By forming the cable 202, or at least the locking portion 208 of the cable 202, with a height $H_{202}$ that is less than the height of the lock elements 164, the ends 218*a*, 218*b* of the cable 202 are maintained within the locking chamber 132 and are less susceptible to rubbing against the inner surface 124 or the cover 106.

In addition to forming the cable 202 with lesser height $H_{202}$ than the lock elements 164, a vertical position of the locking portion 208 is maintained within locking chamber 132 by the offset between the first series 176*a* and the second series 176*b*. For example, as shown in FIG. 5A, where the tips 172 of the upper second series 176*b* of teeth 166 overhang the recesses 174 of the lower first series 176*a* of teeth 166, an exposed lower edge of each tooth 166 of the upper second series 176*b* will grip an intermediate portion of the inner side 220*a* of the cable 202 to restrict movement of the cable 202 towards the top surface 162 of the lock member 108. Likewise, exposed upper edges of the teeth 166 of the lower first series 176*a* will grip the intermediate portion of the inner side 220*a* of the cable 202 to restrict movement of the cable 202 towards the bottom surface 160 of the lock member 108.

The cable 202 may be may be formed from one or more fibers. For instance, the fibers may include polyethylene fibers. Additionally or alternatively, the cable 202 may be formed from a molded monofilament polymer and/or a woven steel with or without other lubrication coating. In some examples, the cable 202 includes multiple strands of material woven together.

FIGS. 4A and 5A provide views of the cable lock 100 with the cover 106 removed to show the locking member 108 disposed within the locking chamber 132 of the housing 104 while in the locked state. In some examples, the locking member 108 is biased into the locked state by the first biasing member 112. For instance, FIGS. 4A and 5A show the first biasing member 112 exerting the engaging force $F_E$ upon the locking member 108 to urge the second end 158 of the locking member 108 toward the second end 118 of the housing 104, and thereby bias the locking member 108 into the locked state. While in the locked state, the locking member 108 restricts movement of the cable 202 relative to the housing 104 by pinching the locking segments 214*a*, 214*b* of the cable 202 between the engagement surfaces 134 of the housing 104 and the lock elements 164 of the locking member 108. Accordingly, the locked state of the locking member 108 restricts the cable 202 from moving in the loosening direction $D_L$ when the loosening force $F_L$ is applied to the fastening portion 206. In the example shown, the locking member 108 permits movement of the cable 202 when the tightening force $F_T$ is applied to the cable 202, as this direction causes the cable 202 to apply a force on the locking member 108 due to the wedge shape of the locking member 108, thereby moving the locking member 108 toward the unlocked state. The locking member 108 automatically returns to the locked state once the force applied to the cable 202 is released due to the forces imparted on the locking member 108 by the biasing member 112.

FIGS. 4B and 5B provide views of the cable lock 100 with the cover 106 removed to show the locking member 108 disposed within the locking chamber 132 of the housing 104 while in the unlocked position. In some examples, the release cord 190 attached to the tab portion 178 of the locking member 108 applies the release force $F_R$ upon the locking member 108 to move the locking member 108 away from the engagement surfaces 134. Here, the release force $F_R$ is sufficient to overcome the engaging force $F_E$ of the first biasing member 112 to permit the locking member 108 to move relative to the housing 104 such that the engagement of the locking segments 214*a*, 214*b* of the cable 202 between the lock elements 164 and the engagement surfaces 134 is released. In some examples, the engaging force $F_E$ causes the locking member 108 to transition back to the locked position when the release force $F_R$ applied by the release cord 190 is removed.

While in the unlocked state, the locking member 108 permits movement of the cable 202 relative to the housing 104 by allowing the locking segments 214*a*, 214*b* of the cable 202 to freely move between the respective lock elements 164 and the engagement surfaces 134. The unlocked state of the locking member 108 permits movement of the cable 202 in both the tightening direction $D_T$ and the loosening direction $D_L$ when the pulling forces $F_T$, $F_L$ are applied to respective ones of the control portion 204 and the fastening portion 206. Movement of the cable 202 in the tightening direction $D_T$ causes the effective length of the fastening portion 206 to decrease to move the article of footwear 1000 into the tightened state around the foot, while movement of the cable 202 in the loosening direction $D_L$ allows an effective length of the fastening portion 206 to transition the article of footwear 1000 from the tightened state to the loosened state such that the foot can be removed.

In some examples, a sufficient magnitude and/or duration of the release force $F_R$ applied to the release cord 190 causes the release cord 190 to apply the release force $F_R$ upon the locking member 108 in a direction opposite the direction of the engaging force $F_E$ such that the locking member 108 moves away from the engagement surfaces 134 relative to the housing 104 and toward the first end 116 of the housing 104. At least one of the retention features 138 of the housing 104 may engage the detent 182 of the locking member 108 when release force $F_R$ moves the locking member 108 a predetermined distance away from the engagement surfaces 134 of the housing 104, as shown in FIG. 4B. Here, engagement between the detents 182 of the locking member 108 and the at least one retention feature 138 of the housing 104 maintains the locking member 108 in the unlocked position once the release force $F_R$ is released. The engaging force $F_E$ of the first biasing member 112 and the forces exerted by the pair of second biasing members 114 on the retention features 138 lock the projections 148 of the retentions features 138 into engagement with the detents 182 of the locking member 108 after the locking member 108 moves the predetermined distance and the release force $F_R$ is no longer applied.

In some scenarios, a release force $F_R$ associated with a first magnitude may be applied to the release cord 190 to move the locking member 108 away from the engagement surfaces 134 by a distance less than the predetermined distance such that the retention features 138 do not engage. In these scenarios, the release force $F_R$ associated with the first magnitude can be maintained when it is desirable to move the cable 202 in the loosening direction $D_L$ (e.g., by applying the loosening force $F_L$ to the fastening portion 206) or the tightening direction $D_T$ (e.g., by applying the tightening force $F_T$ to the control portion 204) for adjusting the fit of the article of footwear 1000 around the foot. Once the desired fit of the article of footwear 1000 around the foot is achieved, the release force $F_R$ can be released to cause the locking member 108 to transition back to the locked position so that movement of the cable 202 is restricted in the loosening direction $D_L$ and the desired fit can be sustained. It should be noted that even when the locking member 108 is in the locked position, the cable 202 can be moved in the tightening direction $D_T$. As such, once the loosening force $F_L$ is released and a desired fit is achieved, the locking member 108 automatically retains the desired fit by locking a position of the cable 202 relative to the housing 104.

In other scenarios, a release force $F_R$ associated with a second magnitude greater than the first magnitude can be applied to the release cord 190 to move the locking member 108 the predetermined distance away from the engagement surfaces 134 to cause the corresponding retention features 138 to engage the detents 182. Engagement of the retention features 138 is facilitated by providing the projections 148 of the retention features 138 with the tapered biasing surface 152 that opposes the locking member 108 to allow the locking member 108 to more easily move the retention features 138 against the biasing force $F_B$ imparted thereon by the second biasing members 114 when the release cord 190 is pulled the predetermined distance. In these scenarios, engagement between the corresponding retention features 138 and the detents 182 maintains the locking member 108 in the unlocked position when the release force $F_R$ is released.

The locking member 108 is returned to the locked position when a tightening force $F_T$ is applied to the control portion 204. Namely, when the tightening force $F_T$ is applied to control portion 204, the first control segment 210*a* and the second control segment 210*b* are placed in tension, which exerts a force on the second biasing members 114 via the distal ends 144 of the tab 140 of the retention features 138, as the first control segment 210*a* and the second control segment 210*b* pass through the first openings 130*a*. In so doing, the distal ends 144 of the retention features 138 compress the second biasing members 114 and cause the projections 148 of the retention features 138 to move away from one another. As a result, the retention features 138 disengage the detents 182 of the locking member 108, allowing the first biasing member 112 to return the locking member 108 to the locked position.

With particular reference to FIGS. 8-10B, a lock device 100*a* and the cable 202 of a tensioning system 10*a* are shown. In view of the substantial similarity in structure and function of the components associated with the tensioning system 10*a* with respect to the tensioning system 10, like reference numerals are used hereinafter and in the drawings to identify like components while like reference numerals containing letter extensions are used to identify those components that have been modified.

In the example of FIGS. 8-10B, the housing 104 and the cable 202 are the same as described above with respect to FIGS. 1-7C. Here, the locking member 108*a* is formed as a unitary body. Accordingly, instead of being formed in a multi-step process where a first portion and a second portion are folded over upon each other, as described above, the locking member 108*a* may be formed in a single step by stamping or cutting the locking member 108*a* from a piece of material having a thickness corresponding to the desired thickness $T_{108}a$ of the locking member 108.

By forming the locking member 108*a* in a single-step process, each of the lock elements 164*a* is formed with a single series of teeth 166*a*. Accordingly, each of the teeth 166*a* may extend continuously along a direction from the bottom surface 160 of the locking member 108*a* to the top surface 162 of the locking member 108*a* to define a height $H_{164a}$ of each of the lock elements 164*a*. In the illustrated example, the height $H_{164a}$ of each of the lock elements 164 is the same as the thickness Tim of the locking member, such that each of the teeth 166*a* extends continuously from the bottom surface 160 to the top surface 162. As with the previous example, the height $H_{164}a$ of the lock elements 164*a* is greater than the height $H_{202}$ of the cable 202. Accordingly, the top end 218*a* and the bottom end 218*b* of the cable 202 are spaced inwardly from the top surface 162 and the bottom surface 160 of the locking member 108*a*.

Figure 11:
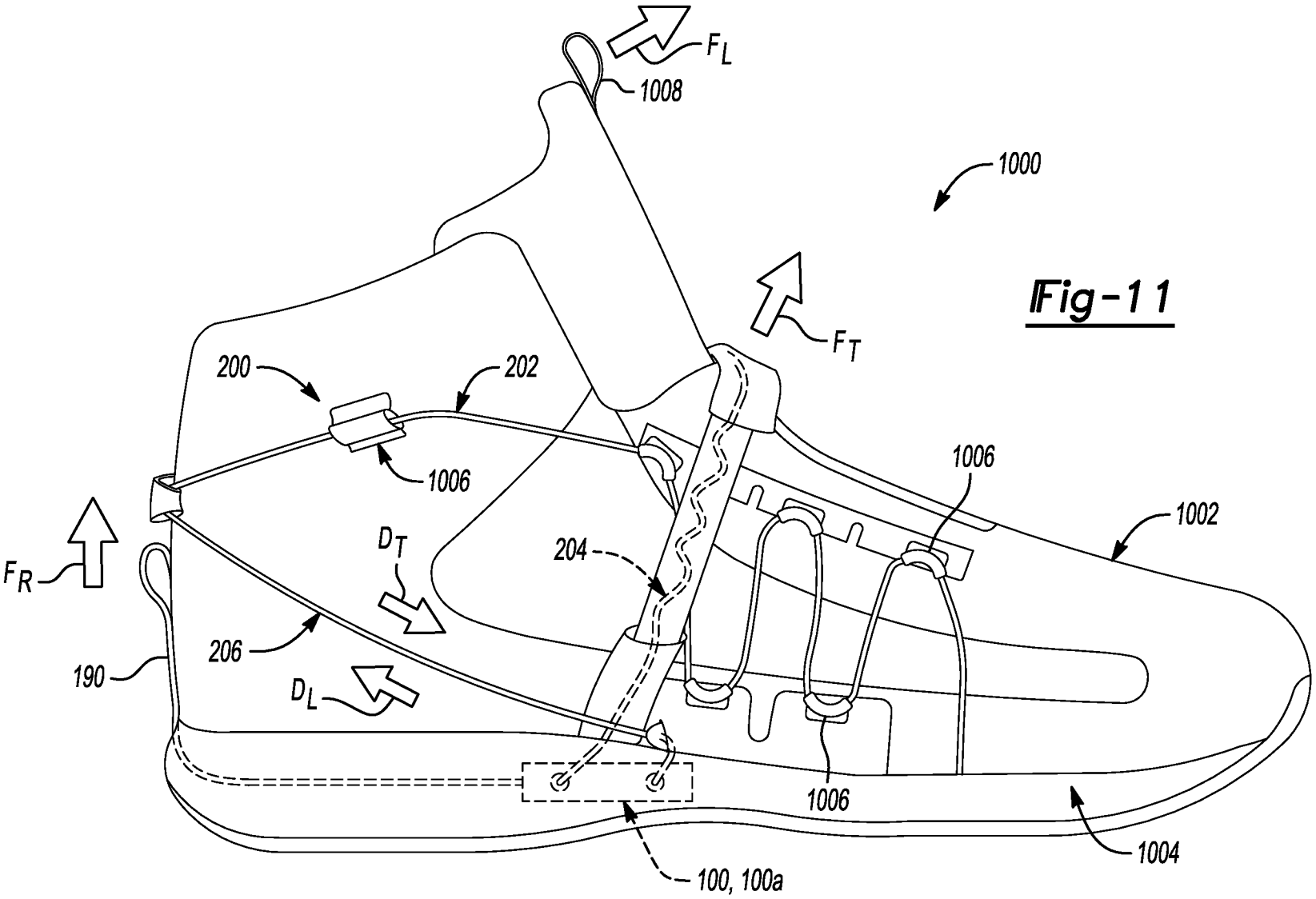
FIG. 11 is a side perspective view of an article of footwear incorporating a cable lock of the present disclosure in a sole structure of the article of footwear
Figure 12:
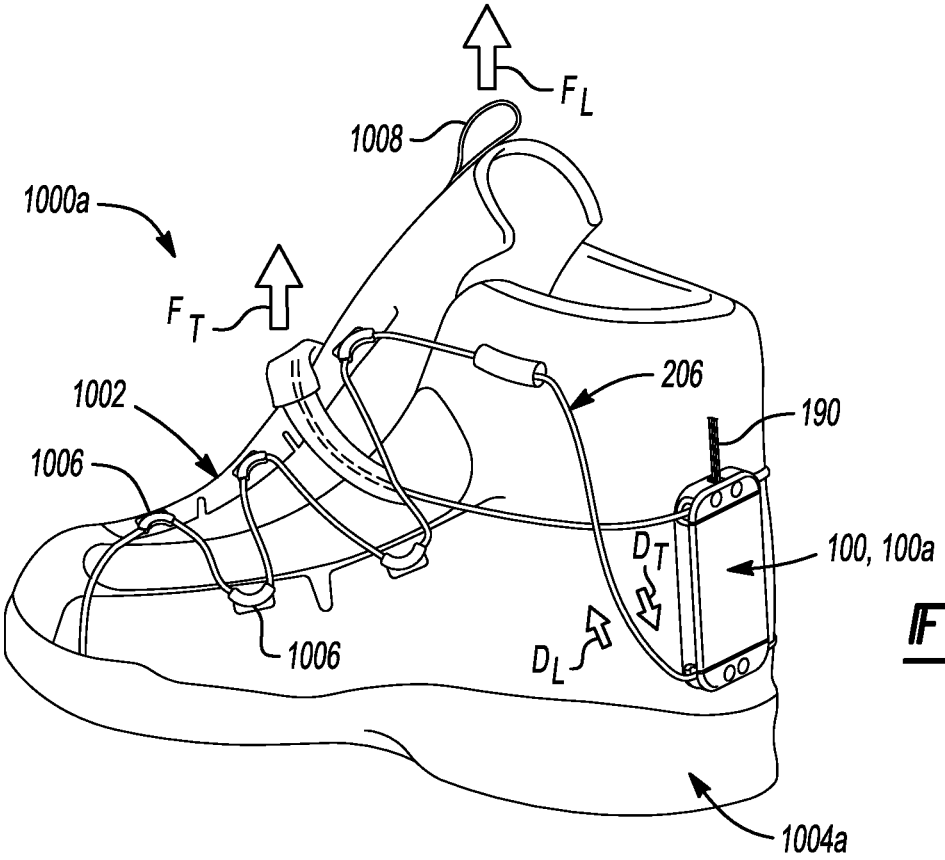
FIG. 12 is a rear perspective view of an article of footwear incorporating a cable lock of the present disclosure at a heel region of the article of footwear.
Figure 13:
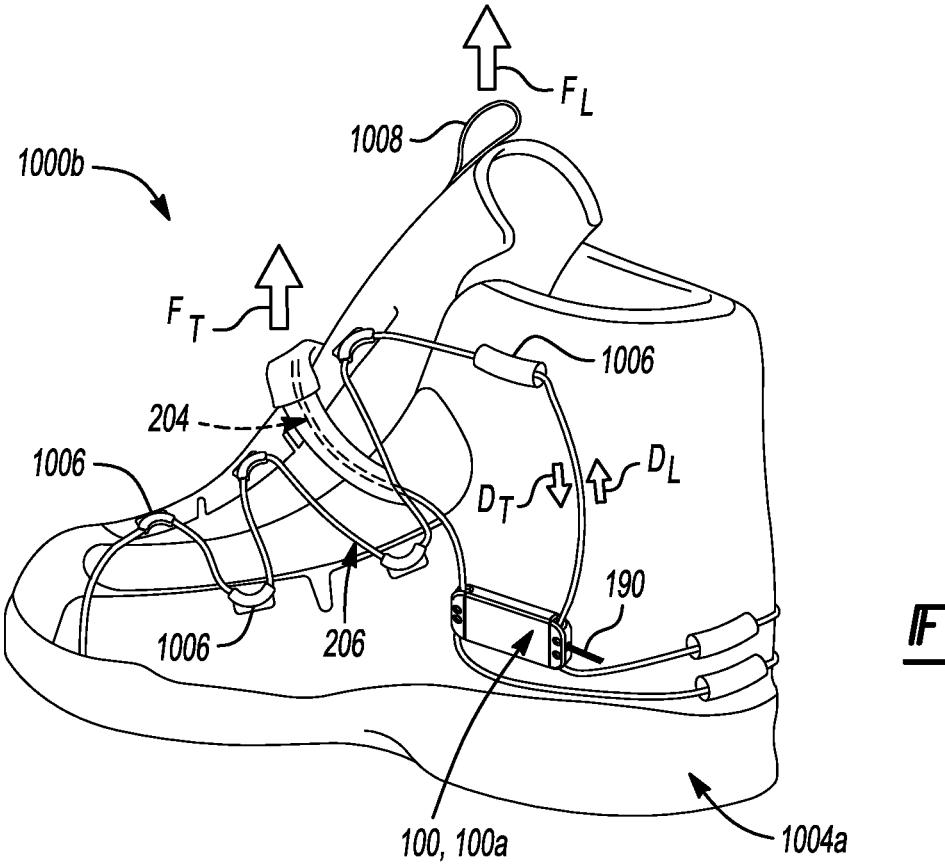
FIG. 13 is a rear perspective view of an article of footwear incorporating a cable lock of the present disclosure at a medial side region of the article of footwear.
Figure 14:
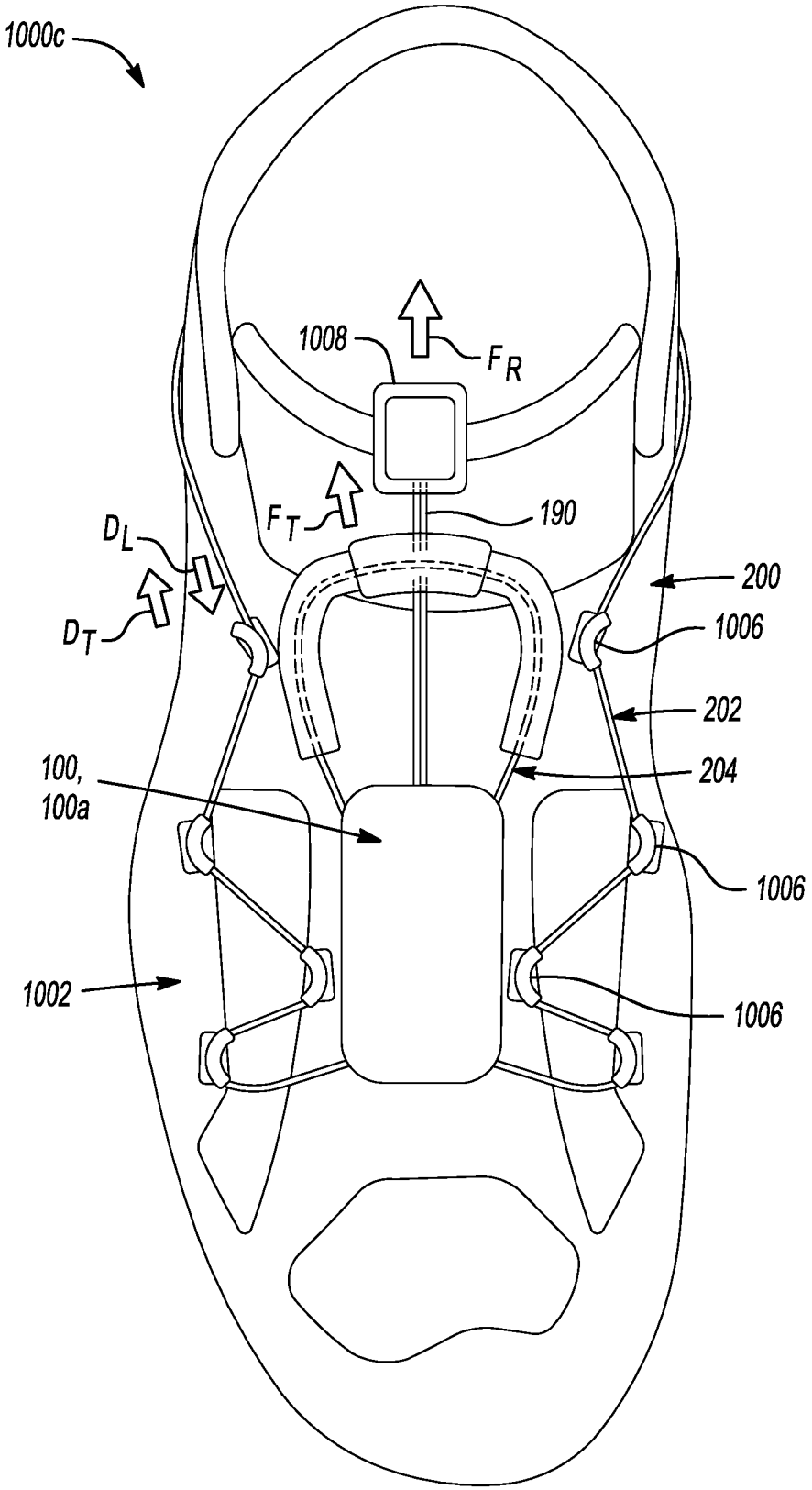
FIG. 14 is a top view of an article of footwear incorporating a cable lock of the present disclosure on a tongue portion of the article of footwear.

With reference to FIGS. 11-14, examples of the article of footwear 1000-1000*c* incorporating the lock device 100 and tensioning system 200 are shown. Each of the articles of footwear includes an upper 1002 and a sole structure 1004, 1004*a* attached to the bottom of the upper. In the example of FIG. 11, the lock device 100, 100*a* is disposed within the sole structure 1004, such that the cable 202 and the release cord 190 are routed through the sole structure 1004 to exterior surfaces of the upper 1002. The cable lock 100 may be disposed at other locations without departing from the scope of the present disclosure. For instance, the location of the cable lock 100 may be under the foot and may shift from the midfoot region to either one of the forefoot region or the heel region. In other configurations, shown in FIGS. 12-14, the cable lock 100 may be disposed upon exterior surfaces of the upper 1002 at any suitable location, such as along the heel region of the upper 1002, as shown in FIGS. 12 and 13, or over the top of the foot (e.g., above the instep) on the upper 1002 or a tongue portion as shown in FIG. 14. In other configurations, the cable lock 100 may be disposed within the interior void of the upper 1002 and between the inner surface of a strobel and a drop-in midsole.

Each of the control portion 204 and the fastening portion 206 are routed along the upper 1002 by a series of cable guides or conduits 1006, which are arranged along the upper 1002 to distribute the tightening force $F_T$ along the upper 1002 when the tightening force $F_T$ is applied to the control portion 204. The routing of the control portion 204, the fastening portion 206, and the release cord 190 may be adapted to accommodate a change in location for the cable lock 100 so that the upper 1002 may be moved between the loosened state and the tightened state. The passages enclosing the second end of the release cord 190 may be disposed at a lateral side or a medial side of the upper 1002, or any other suitable location.

As discussed above, the cable lock 100, 100*a* is operable between a locked state restricting movement of the cable 202 in the loosening direction $D_L$ and an unlocked state permitting movement of the cable 202 in both the loosening direction $D_L$ and the tightening direction $D_T$. In some implementations, the cable lock 100, 100*a* permits movement of the cable 202 in the tightening direction $D_T$ when the cable lock 100, 100*a* is in the locked state. This arrangement allows the cable 202 to move in the tightening direction $D_T$ each time the tightening force $F_T$ is applied to the control portion 204 while restricting movement in either the tightening direction $D_T$ or the loosening direction $D_L$ when the tightening force $F_T$ is released. In doing so, the article of footwear 1000-1000*c* can be incrementally tightened around the foot until a desired fit is achieved. In these implementations, the cable lock 100, 100*a* must transition from the locked state to the unlocked state to permit the cable 202 to move in the loosening direction $D_L$ when the loosening force $F_L$ is applied to the fastening portion 206. In other words, the cable 202 is restricted from moving in the loosening direction $D_L$ when the loosening force $F_L$ is applied to the fastening portion 206 unless the cable lock 100 is in the unlocked state.

The cable 202 is movable in the tightening direction $D_T$ when a tightening force $F_T$ is applied to the control portion 204 to pull the control portion 204 away from the upper 1100 to tighten the cable guides 412, and thereby move the upper 1100 into the tightened state. For example, once a foot is received by article of footwear 1000-100*c* and supported upon the sole structure 1004, 1004*a*, the upper 1002 may be automatically tightened to secure the fit around the foot by applying the tightening force $F_T$ to the control portion 204 without the need of having to manually tie shoe laces or manually fasten other fasteners to tighten the upper 1002. Here, the movement of the cable 202 in the tightening direction $D_T$ causes an effective length of the control portion 204 to increase and an effective length of the fastening portion 206 to decrease. The decrease in the effective length of the fastening portion 206 is operative to tighten the upper 1002 around the foot such that the foot is secured within the article of footwear 1000-1000*c* while supported upon the sole structure 1004, 1004*a*. Namely, decreasing the effective length of the fastening portion 206 exerts a tensioning force on the cable guides 1006, thereby causing the cable guides 1006 to be drawn towards each other and tighten the upper 1002 around the foot.

In some examples, a desired fit of the interior void 1102 around the foot is adjustable based upon a magnitude of the tightening force $F_T$ applied to the control portion 204. For instance, increasing the magnitude of the tightening force $F_T$ may move the cable 202 further in the tightening direction $D_T$ such that the tightening of the cable guides 1006 along the upper 1002 increases to achieve a tighter fit around the foot. Additionally or alternatively, the fit of the article of footwear 1000-1000*c* around the foot may be adjustable based upon a duration of the tightening force $F_T$ applied to the control portion 204. For instance, tightening forces $F_T$ applied to the control portion 204 for longer durations may result in the cable 202 moving a further distance in the tightening direction $D_T$ to achieve a tighter fit of the interior void 1102 around the foot.

In the illustrated example, the cable 202 may be indirectly caused to move in the loosening direction $D_L$ by pulling a loosening grip 1008 attached to a tongue portion of the upper 1002. For example, the when the loosening force $F_L$ is applied to the loosening grip 1008, the tongue portion is pulled in a direction away from the upper 1002 to expand an interior cavity of the upper 1002. As a result of the tongue portion being pulled away from the upper 1002, the cable guides 1006 are pulled apart from each other, and the effective length of the fastening portion 206 is caused to increase. When the loosening force $F_L$ is released from the loosening grip 1008, the upper 1002 may move to a relaxed state, whereby the increased effective length of the fastening portion 206 allows the upper 1002 to be expanded for donning or doffing of the footwear 1000. In other examples, the loosening force $F_L$ may be applied directly to the fastening portion 206 to increase the effective length of the fastening portion 206. For example, the fastening portion 206 may include one or more pull tabs that can be grasped by the user for applying the loosening force $F_L$.

Accordingly, the footwear 1000 may be donned and doffed without having to untie shoe laces or unfasten one or more fasteners to loosen the upper 1002. Particularly, as the cable 202 moves in the loosening direction $D_L$, an effective length of the fastening portion 206 of the cable 202 is increased as the effective length of the control portion 204 is decreased. Here, the increase to the effective length of the fastening portion 206 allows the cable guides 1006 to move away from each other to facilitate a transition of the upper 1002 from the tightened state to the loosened state such that the foot can be removed.

The following Clauses provide exemplary configurations for an article of footwear, a cable lock, and a method in accordance with the principles of the present disclosure.

Clause 1: A cable lock comprising a housing including a first engagement surface and a second engagement surface spaced apart from the first engagement surface, and a locking member slideably disposed between the first engagement surface and the second engagement surface and including a first lock element opposing the first engagement surface to define a first locking channel and a second lock element opposing the second engagement surface to define a second locking channel, the first lock element (i) including a first series of teeth and a second series of teeth arranged in parallel with the first series of teeth and (ii) operable to engage a first portion of a cable disposed within the first locking channel and the second lock element (i) including a first series of teeth and a second series of teeth arranged in parallel with the first series of teeth of the second lock element and (ii) operable to engage a second portion of the cable disposed within the second locking channel.

Clause 2: The cable lock of Clause 1, wherein the locking member includes a bottom surface and a top surface formed on an opposite side of the locking member from the bottom surface, the first series of teeth of the first lock element and the second lock element extending adjacent to the bottom surface and the second series of teeth of the first lock element and the second lock element extending adjacent to the top surface.

Clause 3: The cable lock of any of the preceding Clauses, wherein the first series of teeth of the first lock element and the second lock element are staggered from the second series of teeth of the first lock element and the second lock element, respectively.

Clause 4: The cable lock of any of the preceding Clauses, wherein the first series of teeth of the first lock element and the second lock element include a first series of recesses formed between adjacent ones of the teeth of the first series of teeth, each of the teeth of the second series of teeth of the first lock element and the second lock element being aligned with one of the recesses of the first series of recesses.

Clause 5: The cable lock of Clause 4, wherein the second series of teeth of the first lock element and the second lock element include a second series of recesses formed between adjacent ones of the teeth of the second series of teeth, each of the teeth of the first series of teeth being aligned with one of the recesses of the second series of recesses.

Clause 6: The cable lock of any of the preceding Clauses, wherein each of the first lock element and the second lock element is formed at an oblique angle relative to a longitudinal axis of the locking member.

Clause 7: The cable lock of Clause 6, wherein the oblique angle ranges from 2 degrees to 12 degrees.

Clause 8: The cable lock of Clause 6, wherein the oblique angle ranges from 4 degrees to 8 degrees.

Clause 9: The cable lock of Clause 6, wherein the oblique angle is 6 degrees.

Clause 10: The cable lock of Clause 6, wherein the first lock element is parallel to the first engagement surface and the second lock element is parallel to the second engagement surface.

Clause 11: The cable lock of any of the preceding Clauses, wherein the cable has an inner side and an outer side formed on an opposite side of the cable from the inner side, a distance from the inner side to the outer side defining a width of the cable.

Clause 12: The cable lock of Clause 11, wherein the inner side faces the first lock element and the second lock element, and the outer side faces the first engagement surface and the second engagement surface.

Clause 13: The cable lock of Clause 12, wherein the cable has a top end and a bottom end disposed on an opposite end of the cable from the top end, a distance from the top end to the bottom end defining a height of the cable, the height of the cable being less than a height of the first lock element and the second lock element.

Clause 14: The cable lock of Clause 13, wherein the height of the cable is greater than the width of the cable.

Clause 15: The cable lock of Clause 13, wherein the inner side is substantially straight from the top end to the bottom end and the outer side is substantially straight from the top end to the bottom end.

Clause 16: The cable lock of any of the preceding Clauses, further comprising a biasing spring operable to apply a biasing force and to bias the locking member toward a locked state.

Clause 17: The cable lock of Clause 16, further comprising a release cord attached to the locking member and operable to move the locking member from the locked state to an unlocked state when a tensile force exceeding the biasing force of the biasing spring is applied to the release cord in an unlocking direction.

Clause 18: The cable lock of Clause 17, wherein the release cord is attached to the locking member at an opposite end of the locking member than the biasing spring.

Clause 19: An article of footwear including the cable lock of any of the preceding Clauses.

Clause 20: A locking member for a cable lock, the locking member comprising a first lock element extending along a direction from a first end of the locking member to a second end of the locking member, the first lock element including a first series of teeth and a second series of teeth in parallel with the first series of teeth, and a second lock element extending along the direction from the first end of the locking member to the second end of the locking member and formed on an opposite side of the locking member from the first lock element, the second lock element including a third series of teeth and a fourth series of teeth in parallel with the third series of teeth.

Clause 21: The locking member of Clause 20, further comprising a bottom surface and a top surface formed on an opposite side of the locking member from the bottom surface, the first series of teeth and the third series of teeth extending adjacent to the bottom surface, and the second series of teeth and the fourth series of teeth extending adjacent to the top surface.

Clause 22: The locking member of any of the preceding Clauses, wherein the first series of teeth is staggered from the second series of teeth, and the third series of teeth is staggered from the fourth series of teeth.

Clause 23: The locking member of any of the preceding Clauses, wherein the first series of teeth defines a first series of recesses, the teeth of the second series of teeth being aligned with the first series of recesses.

Clause 24: The locking member of any of the preceding Clauses, wherein the third series of teeth defines a second series of recesses, the teeth of the fourth series of teeth being aligned with the second series of recesses.

Clause 25: The locking member of any of the preceding Clauses, wherein each of the first lock element and the second lock element is formed at an oblique angle to a longitudinal axis of the locking member.

Clause 26: The locking member of Clause 25, wherein the oblique angle ranges from 2 degrees to 12 degrees.

Clause 27: The locking member of Clause 25, wherein the oblique angle ranges from 4 degrees to 8 degrees.

Clause 28: The locking member of Clause 25, wherein the oblique angle is 6 degrees.

Clause 29: An article of footwear including the locking member of any of the preceding Clauses.

Clause 30: A method of forming a locking member, the method comprising forming a locking member blank having a first thickness, the locking member blank including (i) a first portion including a first lock element and a second lock element formed on an opposite side of the first portion from the first lock element, (ii) a second portion including a third lock element and a fourth lock element formed on an opposite side of the second portion from the third lock element, and (iii) an intermediate portion connecting the first portion and the second portion, and bending the locking member blank along the intermediate portion to fold the first portion upon the second portion, the first lock element and the third lock element being arranged in parallel with each other, and the second lock element and the fourth lock element being arranged in parallel with each other.

Clause 31: The method of Clause 30, wherein forming the locking member blank includes forming each of the first lock element, the second lock element, the third lock element, and the fourth lock element with a series of teeth, each of the series of teeth defining a corresponding series of recesses disposed between adjacent ones of the teeth.

Clause 32: The method of Clause 31, wherein bending the locking member blank includes aligning the series of teeth of the first lock element with the series of recesses of the third lock element and aligning the series of teeth of the second lock element with the series of recesses of the fourth lock element.

Clause 33: The method of any of the preceding Clauses, further comprising deburring the locking member blank.

Clause 34: The method of any of the preceding Clauses, wherein the locking member blank is formed of a metal.

Clause 35: The method of any of the preceding Clauses, wherein the locking member blank is formed of an aluminum alloy.

Clause 36: The method of any of the preceding Clauses, wherein forming the locking member blank includes stamping the locking member blank in a progressive die.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A cable lock comprising:

a housing including a first engagement surface and a second engagement surface spaced apart from the first engagement surface; and a locking member slideably disposed between the first engagement surface and the second engagement surface and including a first lock element opposing the first engagement surface to define a first locking channel and a second lock element opposing the second engagement surface to define a second locking channel, (a) the first lock element (i) including a first series of teeth, a first series of recesses formed between adjacent ones of the teeth of the first series of teeth, and a second series of teeth arranged in parallel with the first series of teeth and each aligned with one of the recesses of the first series of recesses and (ii) operable to engage a first portion of a cable disposed within the first locking channel and (b) the second lock element (i) including a first series of teeth, a first series of recesses formed between adjacent ones of the teeth of the first series of teeth of the second lock element, and a second series of teeth arranged in parallel with the first series of teeth of the second lock element and each aligned with one of the recesses of the first series of recesses of the second lock element and (ii) operable to engage a second portion of the cable disposed within the second locking channel.

2. The cable lock of claim 1, wherein the locking member includes a bottom surface and a top surface formed on an opposite side of the locking member from the bottom surface, the first series of teeth of the first lock element and the second lock element extending adjacent to the bottom surface and the second series of teeth of the first lock element and the second lock element extending adjacent to the top surface.

3. The cable lock of claim 1, wherein the first series of teeth of the first lock element and the second lock element are staggered from the second series of teeth of the first lock element and the second lock element, respectively.

4. The cable lock of claim 1, wherein the second series of teeth of the first lock element and the second lock element include a second series of recesses formed between adjacent ones of the teeth of the second series of teeth, each of the teeth of the first series of teeth being aligned with one of the recesses of the second series of recesses.

5. The cable lock of claim 1, wherein each of the first lock element and the second lock element is formed at an oblique angle relative to a longitudinal axis of the locking member.

6. The cable lock of claim 5, wherein the first lock element is parallel to the first engagement surface and the second lock element is parallel to the second engagement surface.

7. The cable lock of claim 1, wherein a height of the cable is less than a height of the first lock element and the second lock element.

8. The cable lock of claim 1, further comprising a biasing spring operable to apply a biasing force to bias the locking member toward a locked state.

9. An article of footwear including the cable lock of claim 1.

10. A locking member for a cable lock, the locking member comprising:

a first lock element extending along a direction from a first end of the locking member to a second end of the locking member, the first lock element including (i) a first series of teeth defining a first series of recesses and (iii) a second series of teeth in parallel with the first series of teeth, teeth of the second series of teeth being aligned with recesses of the first series of recesses; and a second lock element extending along the direction from the first end of the locking member to the second end of the locking member and formed on an opposite side of the locking member from the first lock element, the second lock element including a third series of teeth and a fourth series of teeth in parallel with the third series of teeth.

11. The locking member of claim 10, further comprising a bottom surface and a top surface formed on an opposite side of the locking member from the bottom surface, the first series of teeth and the third series of teeth extending adjacent to the bottom surface, and the second series of teeth and the fourth series of teeth extending adjacent to the top surface.

12. The locking member of claim 10, wherein the first series of teeth is staggered from the second series of teeth, and the third series of teeth is staggered from the fourth series of teeth.

13. The locking member of claim 10, wherein the third series of teeth defines a second series of recesses, the teeth of the fourth series of teeth being aligned with the second series of recesses.

14. The locking member of claim 10, wherein each of the first lock element and the second lock element is formed at an oblique angle to a longitudinal axis of the locking member.

15. The locking member of claim 14, wherein the oblique angle ranges from 2 degrees to 12 degrees.

16. The locking member of claim 14, wherein the oblique angle ranges from 4 degrees to 8 degrees.

17. The locking member of claim 14, wherein the oblique angle is 6 degrees.

18. An article of footwear including the locking member of claim 10.

* * * * *